US007808467B2

(12) United States Patent
Kawata

(10) Patent No.: US 7,808,467 B2
(45) Date of Patent: Oct. 5, 2010

(54) ELECTRO-OPTICAL DEVICE, METHOD OF DRIVING ELECTRO-OPTICAL DEVICE, DRIVING CIRCUIT, AND ELECTRONIC APPARATUS

(75) Inventor: Hirotaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 785 days.

(21) Appl. No.: 11/618,040

(22) Filed: Dec. 29, 2006

(65) Prior Publication Data

US 2007/0200810 A1 Aug. 30, 2007

(30) Foreign Application Priority Data

Feb. 28, 2006 (JP) ..... 2006-052202

(51) Int. Cl.
*G09G 3/36* (2006.01)

(52) U.S. Cl. ..... 345/89; 345/87; 345/98; 345/204

(58) Field of Classification Search ..... 345/89, 345/87, 98, 204
See application file for complete search history.

(56) References Cited

U.S. PATENT DOCUMENTS

| | | | | |
|---|---|---|---|---|
| 5,748,165 | A * | 5/1998 | Kubota et al. | 345/96 |
| 6,239,779 | B1 * | 5/2001 | Furuya et al. | 345/87 |
| 6,636,206 | B1 * | 10/2003 | Yatabe | 345/204 |
| 7,265,744 | B2 * | 9/2007 | Lee et al. | 345/103 |
| 2003/0179221 | A1 * | 9/2003 | Nitta et al. | 345/690 |
| 2005/0206597 | A1 * | 9/2005 | Ishii | 345/87 |
| 2005/0206604 | A1 * | 9/2005 | Washio et al. | 345/98 |
| 2006/0038756 | A1 * | 2/2006 | Bae et al. | 345/76 |
| 2006/0097966 | A1 * | 5/2006 | Choi | 345/77 |
| 2006/0152464 | A1 * | 7/2006 | Ishii | 345/98 |
| 2006/0206604 | A1 * | 9/2006 | O'Neil et al. | 709/223 |
| 2008/0079679 | A1 * | 4/2008 | Ozawa | 345/89 |

FOREIGN PATENT DOCUMENTS

| | | |
|---|---|---|
| JP | A 2000-112437 | 4/2000 |
| JP | A-2001-337654 | 12/2001 |
| JP | A-2003-233086 | 8/2003 |
| JP | A 2004-177930 | 6/2004 |
| JP | A-2005-115342 | 4/2005 |
| JP | A-2005-156633 | 6/2005 |
| JP | A-2005-227391 | 8/2005 |

* cited by examiner

*Primary Examiner*—Bipin Shalwala
*Assistant Examiner*—Afroza Y Chowdhury
(74) *Attorney, Agent, or Firm*—Oliff & Berridge, PLC

(57) ABSTRACT

A method of driving an electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected is provided. The method includes: selecting the plurality of scan lines in a predetermined order; dividing a period of time, when one of the scan lines is selected, into a first period and a second period; selecting m (where m is an integer greater than or equal to 2) lines from one of an odd group and an even group consisting of odd-numbered and even-numbered data lines, respectively, in the first period; selecting m data lines from the other of the odd group and the even group of data lines in the second period; and sampling data signals supplied to m image signal lines and supplying the sampled data signals to the selected m data lines.

8 Claims, 28 Drawing Sheets

<HORIZONTAL SCAN: (ODD-NUMBERED ROW FIRST)>

<HORIZONTAL SCAN: (EVEN-NUMBERED ROW FIRST)>

FIG. 16A

ODD-NUMBERED FRAME

PIXEL ROWS →

| PIXEL COLUMNS ↓ | 1 | 2 | 3 | 4 | 5 | 6 | 7 | 8 | 9 | 10 | 11 | 12 | 13 | 14 | 15 | 16 | 17 | 18 | ..... | 1147 | 1148 | 1149 | 1150 | 1151 | 1152 |
|---|---|---|---|---|---|---|---|---|---|---|---|---|---|---|---|---|---|---|---|---|---|---|---|---|---|
| 1 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 2 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 3 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 4 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 5 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 6 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 7 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 8 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 9 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 10 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 11 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 12 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| ⋮ | | | | | | | | | | | | | | | | | | | | | | | | | |
| 863 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 864 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |

100

FIG. 16B

EVEN-NUMBERED FRAME

PIXEL ROWS →

| PIXEL COLUMNS ↓ | 1 | 2 | 3 | 4 | 5 | 6 | 7 | 8 | 9 | 10 | 11 | 12 | 13 | 14 | 15 | 16 | 17 | 18 | ..... | 1147 | 1148 | 1149 | 1150 | 1151 | 1152 |
|---|---|---|---|---|---|---|---|---|---|---|---|---|---|---|---|---|---|---|---|---|---|---|---|---|---|
| 1 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 2 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 3 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 4 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 5 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 6 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 7 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 8 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 9 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 10 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 11 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 12 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| ⋮ | | | | | | | | | | | | | | | | | | | | | | | | | |
| 863 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 864 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |

100

FIG. 19A

ODD-NUMBERED FRAME

PIXEL ROWS →

| PIXEL COLUMNS ↓ | 1 | 2 | 3 | 4 | 5 | 6 | 7 | 8 | 9 | 10 | 11 | 12 | 13 | 14 | 15 | 16 | 17 | 18 | ..... | 1147 | 1148 | 1149 | 1150 | 1151 | 1152 |
|---|---|---|---|---|---|---|---|---|---|---|---|---|---|---|---|---|---|---|---|---|---|---|---|---|---|
| 1 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 2 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 3 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 4 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 5 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 6 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 7 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 8 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 9 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 10 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 11 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 12 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| ⋮ | | | | | | | | | | | | | | | | | | | | | | | | | |
| 863 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 864 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |

100

FIG. 19B

EVEN-NUMBERED FRAME

PIXEL ROWS →

| PIXEL COLUMNS ↓ | 1 | 2 | 3 | 4 | 5 | 6 | 7 | 8 | 9 | 10 | 11 | 12 | 13 | 14 | 15 | 16 | 17 | 18 | ..... | 1147 | 1148 | 1149 | 1150 | 1151 | 1152 |
|---|---|---|---|---|---|---|---|---|---|---|---|---|---|---|---|---|---|---|---|---|---|---|---|---|---|
| 1 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 2 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 3 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 4 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 5 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 6 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 7 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 8 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 9 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 10 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| 11 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 12 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |
| ⋮ | | | | | | | | | | | | | | | | | | | | | | | | | |
| 863 | 2 | 1 | 2 | 1 | 2 | 1 | 2 | 1 | 2 | 1 | 2 | 1 | 2 | 1 | 2 | 1 | 2 | 1 | ..... | 2 | 1 | 2 | 1 | 2 | 1 |
| 864 | 1 | 2 | 1 | 2 | 1 | 2 | 1 | 2 | 1 | 2 | 1 | 2 | 1 | 2 | 1 | 2 | 1 | 2 | ..... | 1 | 2 | 1 | 2 | 1 | 2 |

100

ODD-NUMBERED FRAME

EVEN-NUMBERED FRAME

<HORIZONTAL SCAN: (EVEN-NUMBERED ROW FIRST)>

ELECTRO-OPTICAL DEVICE, METHOD OF DRIVING ELECTRO-OPTICAL DEVICE, DRIVING CIRCUIT, AND ELECTRONIC APPARATUS

BACKGROUND

1. Technical Field

The present invention relates to a technique for making deterioration in display quality occurring at the time of sampling a phase-developed data signal invisible.

2. Related Art

Recently, projectors forming a compact and reduced image using a display panel such as a liquid crystal panel and enlarging and projecting the compact and reduced image using an optical system have been widely adopted. Since such projectors do not have a function of creating an image themselves, the projectors are supplied with image data (or image signals) from an upper level apparatus such as a PC or a TV tuner. Since the image data serve to specify a grayscale level (brightness) of pixels and are supplied in such a manner of horizontally and vertically scanning pixels arranged in a matrix, it is desirable to drive display panels used in projectors in the same manner. Therefore, it has been common practice to drive the display panels used in a projector using a dot sequential method in which scan lines are selected in a predetermined order, data lines are sequentially selected in a time period when one scan line is selected, and the selected data line is supplied with data signals which are converted from the image data so as to be suitable for driving liquid crystal.

Meanwhile, there have been efforts for realizing a higher definition of display images such as high vision. The higher definition of the display images may be realized by increasing the number of scan lines and the number of data lines. However, since a frame frequency is fixed, an increase in the number of scan lines may shorten one horizontal scanning period and an increase in the number of data lines may shorten a period for selecting the data lines in the dot sequential method. Therefore, in the dot sequential method, when attempting to achieve higher definition, it may not be possible to secure a sufficient time for supplying the data signals to the data lines, thereby making the writing of data to the pixels insufficient.

In order to solve the insufficient writing of data, a phase-developed driving method has been suggested in JP-A 2000-112437. The phase-developed driving method is a method in which every predetermined number, for example, three, of data lines are grouped together (for example, every six data lines are grouped in JP-A-2000-112437), and the data lines of each group are selected in a predetermined order in one horizontal scanning period, and the selected data lines are supplied with data signals, the time required to perform this operation being increased in accordance with the number of scanning lines in each group. In the phase-developed driving method, since the time for supplying the data signals to the data lines is proportionally increased, for example by three times, compared with the dot sequential method, the phase-developed driving method is considered to be suitable for higher-definition display.

However, in the phase-developed driving method, a vertical stripe pattern in which the grayscale level of pixels is slightly changed in units of the grouped data lines selected at the same time may be produced. Therefore, deterioration of display quality becomes conspicuous in the phase-developed driving method.

SUMMARY

An advantage of an aspect of the invention is that it provides an electro-optical device, a method of driving the electro-optical device, a driving circuit and an electronic apparatus, capable of making deterioration in display quality invisible when employing a phase-developed driving method.

According to an aspect of the invention, there is provided a method of driving an electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, wherein the method includes: selecting the plurality of scan lines in a predetermined order; dividing a period of time, when one of the scan lines is selected, into a first period and a second period; selecting m (where m is an integer greater than or equal to 2) lines from one of an odd group and an even group consisting of odd-numbered and even-numbered data lines, respectively, in the first period; selecting m data lines from the other of the odd group and the even group of data lines in the second period; and sampling data signals supplied to m image signal lines and supplying the sampled data signals to the selected m data lines. According to above aspect of the invention, the m data lines which are sampled at the same time are divided into an odd group of data lines and an even group of data lines, it is possible to make deterioration in display quality invisible In the above aspect, the plurality of data lines may be divided into blocks to form blocks each consisting of 2 m data lines, the blocks may be sequentially specified in each of the first and second periods, m data lines may be selected from one of an odd group and an even group consisting of odd-numbered and even-numbered data lines, respectively, belonging to the specified block in the first period, and m data lines may be selected from the other of the odd group and the even group consisting of odd-numbered and even-numbered data lines, respectively, belonging to the specified block in the second period.

First, in the above aspect, m odd-numbered data lines may be selected in a first period of a period of time when one scan line is selected and m even-numbered data lines are selected in a second period thereof, and m even-numbered data lines may be selected in a first period of a period of time when a scan line next to the one scan line is selected and m odd-numbered data lines are selected in a second period thereof. Secondly, in the above aspect, m odd-numbered data lines may be selected in a first period of one vertical scanning period and m even-numbered data lines are selected in a second period thereof, and m even-numbered data lines may be selected in a first period of a vertical scanning period next to the one vertical scanning period and m odd-numbered data lines are selected in a second period thereof. Thirdly, in the above aspect, in one vertical scanning period, m odd-numbered data lines may be selected in a first period of a period of time when an odd-numbered scan line is selected, m even-numbered data lines are selected in a second period thereof, m even-numbered data lines are selected in a first period of a period of time when an even-numbered scan line next to the selected odd-numbered scan line is selected, and m odd-numbered data lines are selected in a second period thereof, and in a vertical scanning period next to the one vertical scanning period, m even-numbered data lines may be selected in a first period of a period of time when an odd-numbered scan line is selected, m odd-numbered data lines are selected in a second period thereof, m odd-numbered data lines are selected in a first period of a period of time when an even-numbered scan line next to the selected odd-numbered scan line is selected, and m even-numbered data lines are selected in a second period thereof.

In addition, in the above aspect, an region scanning method may be used, in which in one vertical scanning period, m odd-numbered data lines are selected in a first period of a period of time when an odd-numbered scan line is selected, m even-numbered data lines are selected in a second period thereof, m even-numbered data lines are selected in a first period of a period of time when an even-numbered scan line next to the selected odd-numbered scan line is selected, and m odd-numbered data lines are selected in a second period thereof, and in a vertical scanning period next to the one vertical scanning period, m even-numbered data lines are selected in a first period of a period of time when an odd-numbered scan line is selected, m odd-numbered data lines are selected in a second period thereof, m odd-numbered data lines are selected in a first period of a period of time when an even-numbered scan line next to the selected odd-numbered scan line is selected, and m even-numbered data lines are selected in a second period thereof.

In the case of using the region scanning method, it is desirable that the plurality of scan lines are divided into at least a first group and a second group in the arrangement direct on of the scan lines, a vertical scanning period is divided into at least first and second fields, the scan lines belonging to the first and second groups are selected in turn and sequentially in a predetermined direction in each of the first and second fields. In addition, it is desirable that in the first field, the voltage of the data signal is one of a high potential and a low potential with respect to a predetermined potential, and in the second field, the voltage of the data signal is the other of the high potential and the low potential.

In the case of using the region scanning method, it is desirable that in one vertical scanning period, m odd-numbered data lines are selected in a first period of a period of time when one scan line belonging to the first group is selected and m even-numbered data lines are selected in a second period thereof, m odd-numbered data lines are selected in a first period of a period of time when one scan line belonging to the second group is selected and m even-numbered data lines are selected in a second period thereof, n even-numbered data lines are selected in a first period of a period of time when a scan line next to the one scan line belonging to the first group is selected and m odd-numbered data lines are selected in a second period thereof, and m even-numbered data lines are selected in a first period of a period of time when a scan line next to the one scan line belonging to the second group is selected and m odd-numbered data lines are selected in a second period thereof, and in a vertical scanning period next to the one vertical scanning period, m even-numbered data lines are selected in a first period of a period of time when one scan line belonging to the first group is selected and m odd-numbered data lines are selected in a second period thereof, m even-numbered data lines are selected in a first period of a period of time when one scan line belonging to the second group is selected and m odd-numbered data lines are selected in a second period thereof, m odd-numbered data lines are selected in a first period of a period of time when a scan line next to the one scan line belonging to the first group is selected and m even-numbered data lines are selected in a second period thereof, and m odd-numbered data lines are selected in a first period of a period of time when a scan line next to the one scan line belonging to the second group is selected and m even-numbered data lines are selected in a second period thereof.

According to another aspect of the invention, there is provided a method of driving an electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, wherein the method includes: selecting the plurality of scan lines in a predetermined order; dividing the plurality of data lines into blocks so as to form blocks each consisting of two data lines and dividing a period of time, when one of the scan lines is selected, into a first period and a second period; sequentially selecting one of odd blocks and even blocks consisting of odd-numbered and even-numbered data lines, respectively, and selecting two data lines belonging to the selected block in the first period; sequentially selecting the other of the odd blocks and the even blocks and selecting two data lines belonging to the selected block in the second period; and sampling data signals supplied to two image signal lines and supplying the sampled data signals to the selected two data lines In addition to the method of driving an electro-optical device, the invention can be embodied as a driving circuit, an electro-optical device, and an electronic apparatus comprising the electro-optical device.

BRIEF DESCRIPTION OF THE DRAWINGS

FIGS. 16A and 16B are diagrams showing a written state related to the third embodiment.

FIGS. 19A and 19B are diagrams showing a written state related to the fourth embodiment.

DESCRIPTION OF EXEMPLARY EMBODIMENTS

Hereinafter, embodiments of the invention will be described with reference to drawings.

First Embodiment

Figure 1:
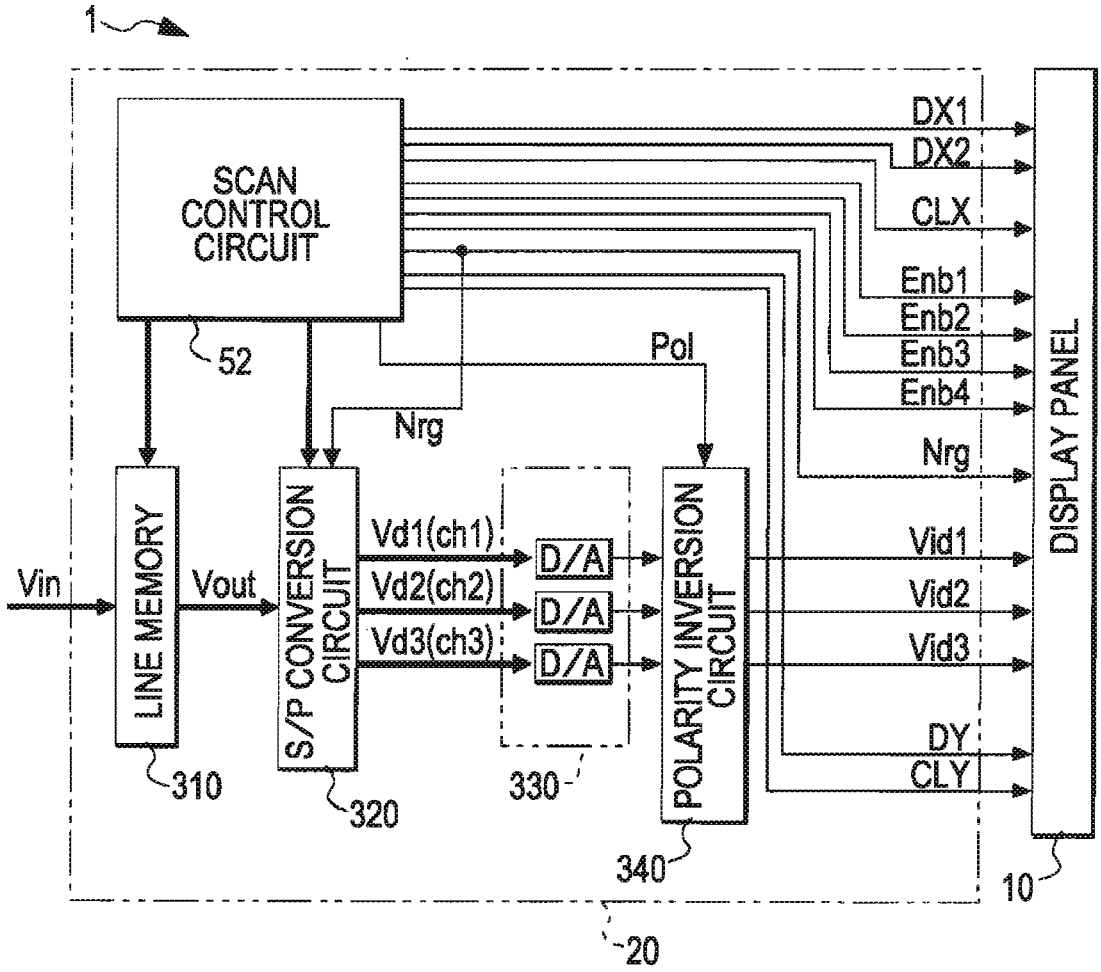
FIG. 1 is a block diagram showing an entire structure of an electro-optical device according to a first embodiment of the invention.

FIG. 1 is a block diagram showing an entire structure of an electro-optical device according to a first embodiment of the invention. As shown in FIG. 1, the electro-optical device 1 can be divided into a display panel 10 and a processing circuit 20. The processing circuit 20 is a circuit for controlling operations of the display panel 10 and embodied as a circuit module mounted on a printed substrate. The display module 10 is connected to a flexible printed circuit (FPC) board, for example.

The processing circuit 20 can be divided into a scan control circuit 52, a line memory 310, an S/P conversion circuit 320, a D/A conversion circuit group 330 and a polarity inversion circuit 340.

The processing circuit 20 stores therein the one-column image data Vin supplied from a higher device (not shown), reads out the image data Vin in accordance with instructions from the scan control circuit 52 and outputs as image data Vout.

The S/P conversion circuit 320 expands (also referred to as a phase-developed driving or a serial-parallel conversion) the image data Vout read from the line memory 310 to three times on the temporal axis and distribute the expanded image data Vout to channels ch1 to ch3 in accordance with instructions from the scan control circuit 52, thereby outputting as image data Vd1 to Vd3.

In this embodiment, when a precharge control signal Nrg is charged to an H level and a precharge mode is designated, the S/P conversion circuit 320 outputs the image data Vd1 to Vd3 corresponding to black, for example, independently of the reading operation from the line memory 310.

The D/A conversion circuit group 330 is a collection of D/A converters provided for each channel and functions to convert the image data Vd1 to Vd3 into an analog voltage corresponding to grayscale level of the image data Vd1 to Vd3.

In this embodiment, the image data Vin is converted into an analog form after performing the phase expansion. However, the image data Vin may be converted into an analog form before performing the phase expansion.

When a positive polarity is indicated by a polarity designation signal Pol, the polarity conversion circuit 340 converts the D/A converted analog signals of three channels into a high-level voltage higher than a reference voltage Vc. On the other hand, when a negative polarity is indicated by a polarity designation signal Pol, the polarity conversion circuit 340 converts the D/A converted analog signals of three channels into a low-level voltage lower than a reference voltage Vc.

The data signals Vid1 to Vid3 is supplied to image signal lines of the display panel 10. The reference voltage Vc has an electric potential corresponding to center amplitude of the data signals, serves as a reference for a pixel writing polarity and corresponds to an intermediate voltage between a source voltage Vdd and the ground voltage Gnd (see FIGS. 8 and 9 for reference). In other words, in this embodiment, when the voltage of the data signal is greater than the reference voltage Vc, the data signal is referred to have a positive polarity. When the voltage of the data signal is lower than the reference voltage Vc, the data signal is referred to have a negative polarity. Moreover, unless explicitly described, the ground potential is used as a reference for a voltage.

The reason for inverting polarities of the data signals by the polarity inversion circuit 340 is to drive the pixels in an alternating manner. As a method of inverting the pixels in a frame period (a vertical scanning period), there are various methods such as inverting the pixels (a) in units of a scan line, (b) in units of a data line (c) in units of a surface (frame). In this embodiment, the polarity is inverted in units of a frame. However, the invention is not limited to this.

The scan control circuit 52 mainly has a first function of controlling a scanning operation onto the display panel 10, a second function of controlling an operation of reading the image data Vin corresponding to one column in accordance with the scanning operation and a third function of controlling a phase-developed driving operation of the S/P conversion circuit in synchronism with a horizontal scanning operation of the display panel 10.

To describe the first function in detail, the scan control circuit 52 controls the horizontal scanning operation of the display pane 10 by generating transmission start pulses DX1 and DX2 and clock signals CLX in synchronism with the supply of the image data Vin and controls a vertical scanning operation of the display panel 10 by generating a transmission start pulse DY and clock signals CLY. Moreover, the scan control circuit 52 outputs the precharge control signal Nrg for precharging the data lines at the time of starting the horizontal scanning period in synchronism with the horizontal scanning operation. As described above, in this embodiment, since the polarity is inverted in units of a frame, the scan control circuit 52 inverts and outputs a logical level of the polarity designation signal Pol at every period of a frame.

Next, to describe the second function in detail, the scan control circuit 52 divides the horizontal scanning period for selecting one column of the data lines into an upper-half period and a lower-half period. In this embodiment, among columns corresponding to the scan lines selected in the corresponding horizontal scanning period, the image data corresponding to the pixels of the odd rows are sequentially read out in the upper-half period and the image data corresponding to the pixels of the even rows are sequentially read out in the lower-half period.

Next, to describe the third function in detail, the scan control circuit 52 controls the phase-developed driving operation by the S/P conversion circuit 320 and outputs four types of enable signals Enb1 to Enb4 in synchronism with the phase-developed driving operation.

Meanwhile, in the display panel 10, an element substrate is bonded to a counter substrate having a common electrode by a sealing material with a predetermined gap therebetween. A TN-type liquid crystal is contained in the gap and an image display can be performed using electro-optical variation of the liquid crystal.

Figure 2:
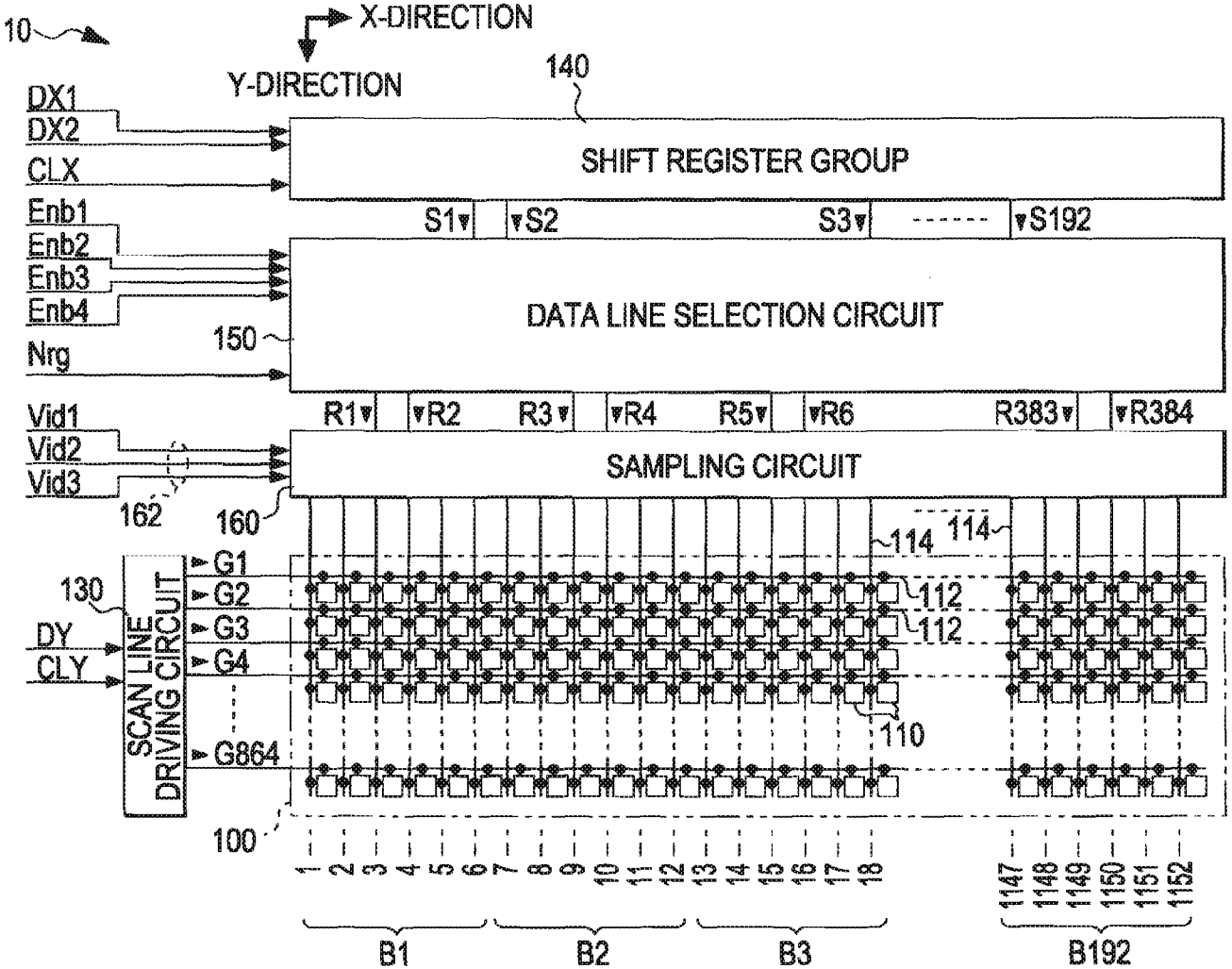
FIG. 2 is block diagram showing a structure of a display panel in the electro-optical device.

FIG. 2 is block diagram showing a detailed structure of the display panel 10.

As shown in FIG. 2, in a display region 100 of the display panel 10, the scan lines 112 of 864 columns extend in an X-direction (horizontal direction) and the data lines 114 of 1152 rows extend in a Y-direction (vertical direction). Moreover, pixels 110 are provided correspondingly to intersections between the scan lines 112 and the data lines 114. Therefore, in the display region 100 of this embodiment, the pixels 110 are arranged in a matrix form of 864 columns×1152 rows.

In this embodiment, the data lines 114 of 1152 rows are sequentially grouped into blocks in units of six rows from the left side of FIG. 2. For the purpose of convenience, the 1st, 2nd, 3rd, . . . , 192-th blocks will be denoted by B1, B2, B3, . . . , B192, respectively.

Figure 3:
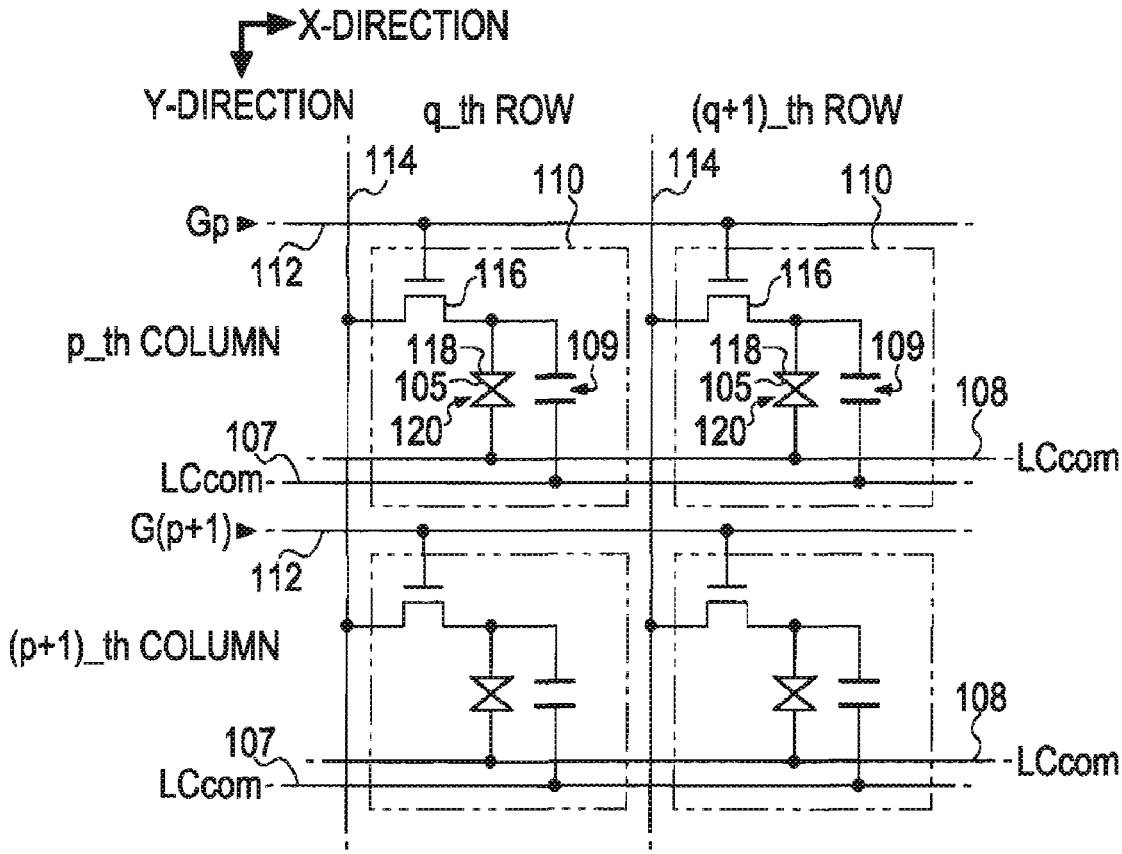
FIG. 3 is diagram showing a structure of a pixel in the display panel.

FIG. 3 is diagram showing a detailed structure of the pixel 110 in the display panel 10. FIG. 3 shows a total of four (2×2) pixels corresponding to intersections between p-th column and (p+1)-th column adjacent to the p-th column and q-th row and (q+1)-th row adjacent to the q-th row. Here, p and (p+1) are symbols representing columns on which the pixels 110 are arranged, and q and (q+1) are symbols representing rows on which the pixels 110 are arranged. In addition, p is an integer between 1 and 864, and q is an integer between 1 and 1152.

As shown in FIG. 3, in the pixel 110, a source of a N-channel type TFT (thin film transistor) 116 is connected to the data line 114, a drain of the TFT 116 is connected to a pixel electrode 118, and a gate of the TFT 116 is connected to the scan line 12.

Meanwhile, a common electrode 108 is commonly provided to the entire pixels so as to face the pixel electrode 118 formed on the element substrate. A liquid crystal 105 is sandwiched between the pixel electrode 118 and the common electrode 108. In this manner, a liquid crystal capacitor 120 constituted by the pixel electrode 118, the common electrode 108 and the liquid crystal 105 is provided at each pixel.

A constant voltage LCcom is applied to the common electrode 108. The voltage (electric potential) LCcom is the same as the reference voltage Vc in this embodiment. However, the voltage LCcom may be set to a voltage a litter lower than the reference voltage Vc for the reasons mentioned later.

In the liquid crystal capacitor 120, an average amount of transmitted light in a unit time is changed in accordance with an effective value of voltage maintained in the liquid crystal capacitor 120. More specifically, as the effective value of the maintained voltage, the liquid crystal capacitor 120 is set to a normally-white mode where the amount of transmitted light increases.

A storage capacitor 109 is provided at each pixel. The storage capacitor 109 is electrically inserted between the drain (the pixel electrode 118) of the TFT 116 and a capacitor line 107 maintained at a constant electric potential, for example the same voltage as the application voltage LCcom of the common electrode 108, so that the storage capacitor 109 is electrically parallel with the liquid crystal 120. In this example, the capacitor line 107 is maintained at the voltage LCcom, but the capacitor line 107 may be maintained at the ground potential Gnd, for example.

Returning to FIG. 2, peripheral circuits such as a scan line driving circuit 130, a shift register group 140 and a data line selection circuit 150 are provided in the vicinity of the display region 100 on which the pixels are arranged.

Figure 6:
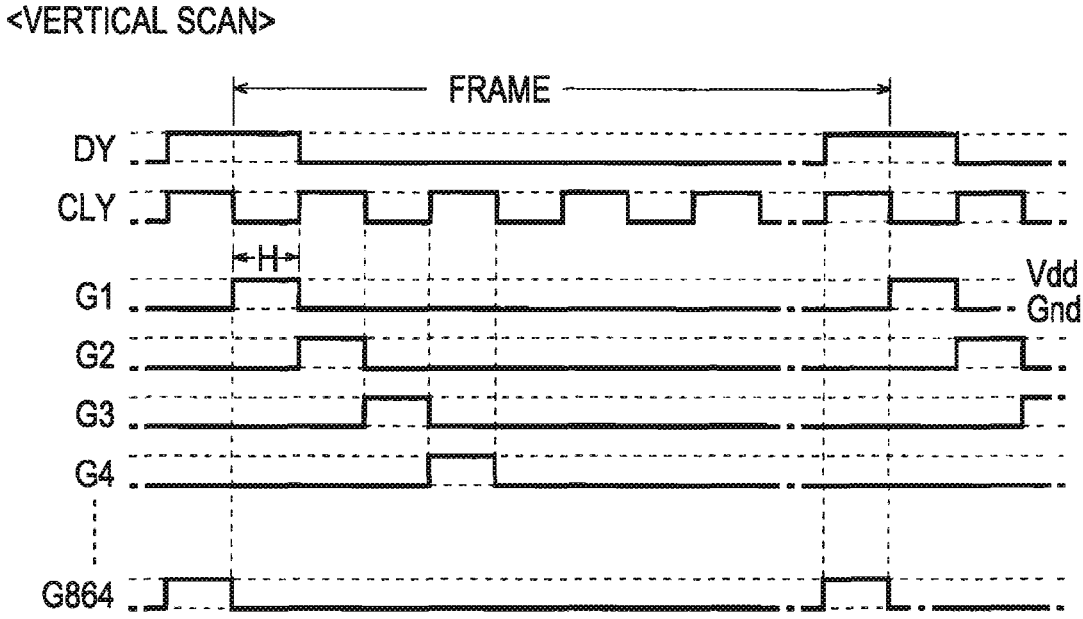
FIG. 6 is a timing diagram for explaining an operation of a vertical scanning in the electro-optical device.

The data line driving circuit 130 supplies the scan signals G1, G2, G3, . . . , G864 to the 1st, 2nd, 3rd, . . . , 864-th row of the scan lines 112. Since details of the scan line driving circuit 130 are not directly related to this invention, a further description will not be made. In the scan line driving circuit 130 of this embodiment, as shown in FIG. 6, the transmission start pulse DY which is first supplied in each frame period and has a pulse width (an H level) corresponding to one cycle of the clock signal CLY is input whenever the level of the clock signal CLY changes, the rear half of the transmission start pulse DY is narrowed into a pulse width corresponding to half cycle of the clock signal CLY, the transmission start pulse DY having a narrowed pulse width is used as the scan signal G1, the scan signal G1 is sequentially delayed by the half cycle of the clock signal CLY, thereby outputting as the scan signals G2, G3, . . . , G864. In this case, the period when the scan signals G1, G2, G3, . . . , G864 are charged to an H level (the period corresponding to the half cycle of the clock signal CLY) corresponds to the horizontal scanning period H. The scan lines to which the H-level scan signals are supplied become a selected state.

Next, a structure of the shift register group 140 will be described with reference to FIG. 4.

Figure 4:
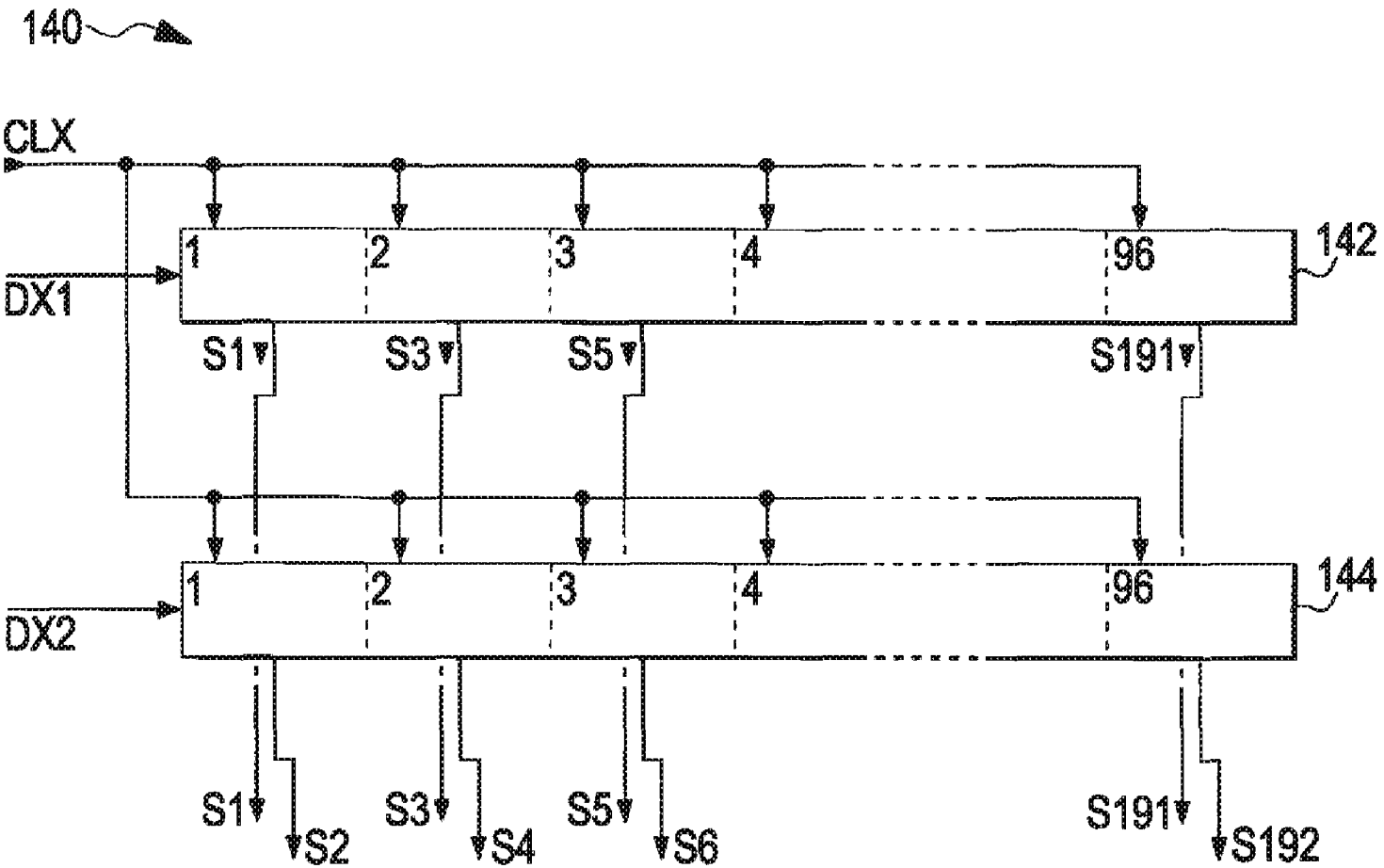
FIG. 4 is a diagram showing a structure of a shift register group in the display panel.

As shown in FIG. 4, the shift register group 140 includes a first shift register 142 and a second shift register 144.

Figure 7:
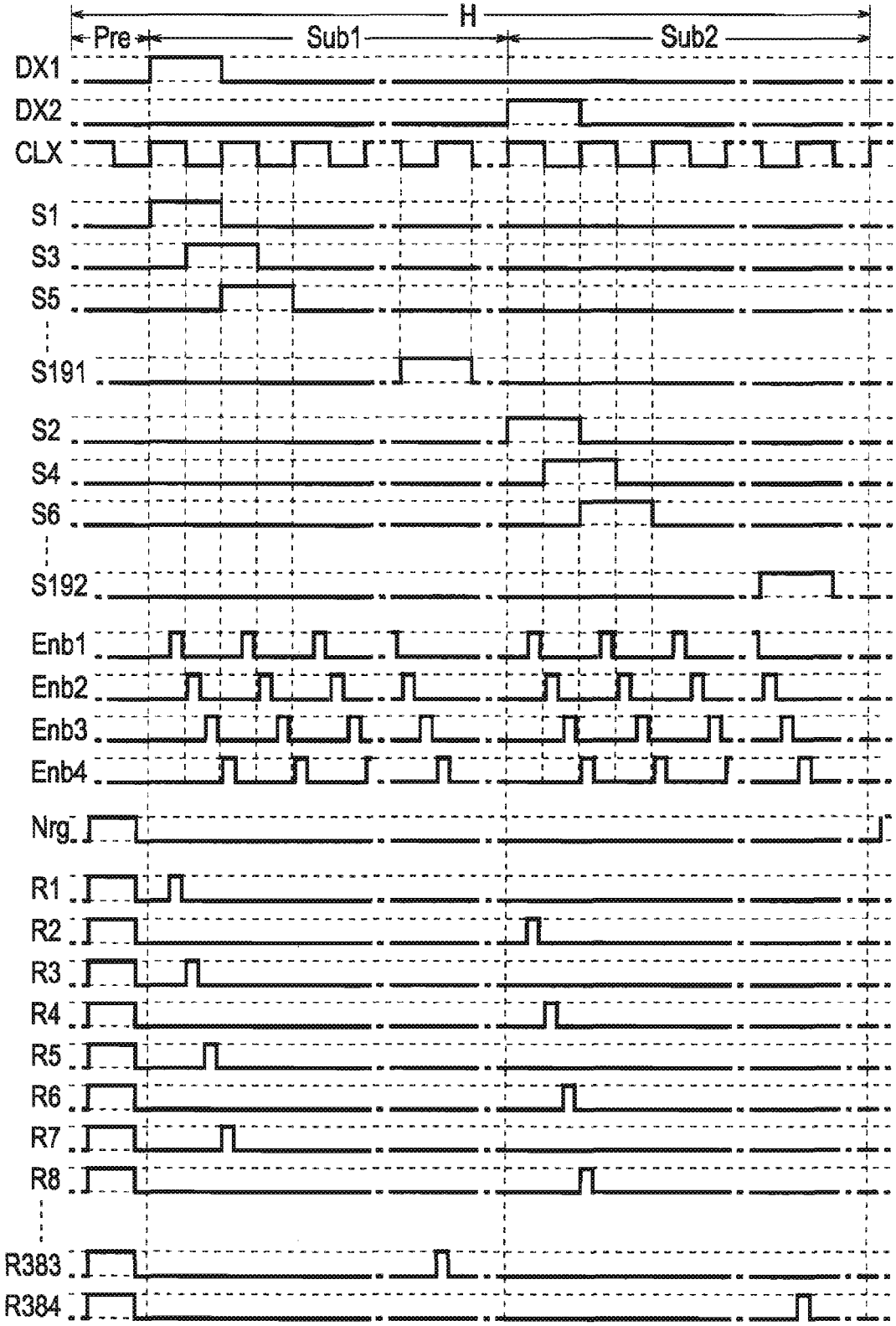
FIG. 7 is a timing diagram for explaining an operation of a horizontal scanning in the electro-optical device.

In this embodiment, the first shift register 142 has 96 stages which are half of 192, the total number of blocks. As shown in FIG. 7, in the first stage of the first shift register 142, the transmission start pulse DX1 which is first supplied in a first period Sub1 of the horizontal scanning period H is input whenever the level of the clock signal CLX changes. The transmission start pulse DX1 is used as the shift signal S1. The shift signal S1 is sequentially delayed by the half cycle of the clock signal CLX in the 2nd, 3rd, . . . , 96th stage of the first shifter register 142, thereby outputting as the odd-numbered shift signals S3, S5, . . . , S191.

Since the transmission start pulse DX1 has a pulse width corresponding to one cycle of the clock signal CLX, the pulse width of the shift signals S1, S3, S5, . . . , S191 overlaps with each other by the half cycle of the clock signal CLX.

In addition, similar to the first shift register 142, the second shift register 144 has 96 stages. As shown in FIG. 7, in the first stage of the second shift register 144 the transmission start pulse DX2 which is first supplied in a second period Sub2 of the horizontal scanning period H is input whenever the level of the clock signal CLX changes. The transmission start pulse DX2 is used as the shift signal S2. The shift signal S2 is sequentially delayed by the half cycle of the clock signal CLX in the 2nd, 3rd, . . . , 96th stage of the first shifter register 142, thereby outputting as the even-numbered shift signals S4, S6, . . . , S192.

Similar to the transmission start pulse DX1, since the transmission start pulse DX2 has a pulse width corresponding to one cycle of the clock signal CLX, the pulse width of the shift signals S2, S4, S6, . . . , S192 overlaps with each other by the half cycle of the clock signal CLX.

Next, a structure of the data line selection circuit 150 will be described with reference to FIG. 5.

Figure 5:
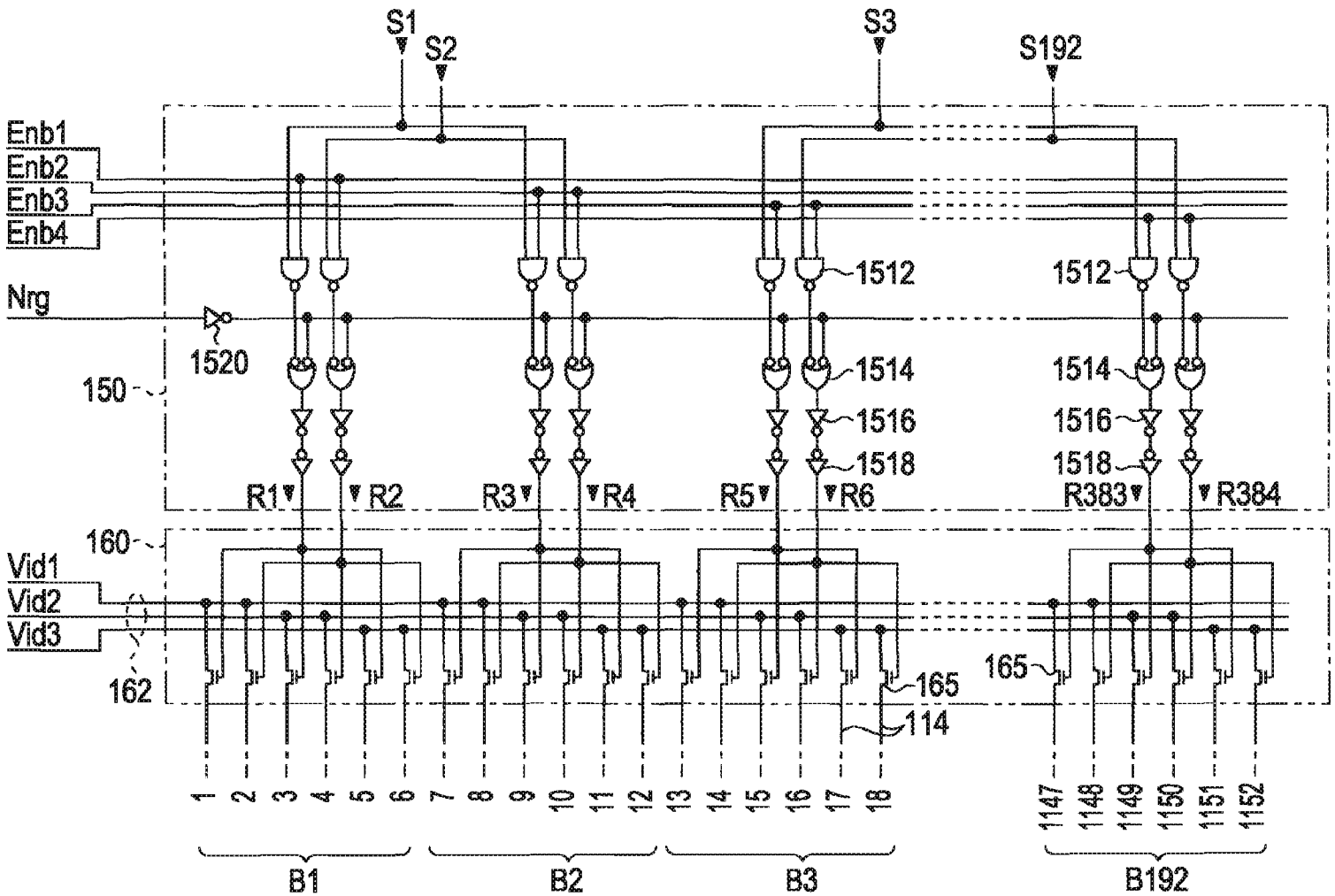
FIG. 5 is a diagram showing a structure of a data line selection circuit in the display panel.

As shown in FIG. 5, the shift signals S1, S2, S3, S4, . . . , S191, S192 are supplied through two paths. More specifically, the shift signal S1 output from the first stage of the first shift register 142 and the shift signal S2 output from the first stage of the second shift register 144 are distributed to blocks B1 and B2, respectively. In general, shift signals S(2j−1) and S(2j) output from j-th stage (j is an integer between 1 and 96) of the first shift register 142 and the second shift register 144 are distributed to blocks B(2j−1) and B(2j), respectively. In other words, shift signals S(2j−1) and S(2j) correspond to block B(2j−1), and shift signals S(2j−1) and S(2j) similarly correspond to block B(2j).

A group of NAND circuits 1512 and 1514 and NOT circuits 1516 and 1518 are provided on the distribution path of the shift signals. The NAND circuit 1512 outputs negative logical product signal between distributed shift signal supplied to one input terminal of the NAND circuit 1512 and any one of enable signals Enb1 to Enb4 supplied to the other input terminal. The NAND circuit 1514 outputs negative logical product signal between the negative logical product signal output from the NAND circuit 1512 and a signal obtained by logically inverting the precharge control signal Nrg by the NOT circuit 1520. The NOT circuit 1516 logically inverts the negative logical product signal output from the NAND circuit 1514. The NOT circuit 1518 logically re-inverts the negative logical product signal output from the NEED circuit 1516.

In the odd-numbered block B(2j−1) a group of output signals from the NOT circuit 1518, which is produced from the shift signal S(2j−1), are denoted by a sampling signal R(4j−3), and a group of output signals from the NOT circuit 1518, which is produced from the shift signal S(2j), are denoted by a sampling signal R(4j−2). Similarly, in the even-numbered block B(2j), a group of output signals from the NOT circuit 1518, which is produced from the shift signal S(2j−1), are denoted by a sampling signal R(4j−1), and a group of output signals from the NOT circuit 1518, which is produced from the shift signal S(2j), are denoted by a sampling signal R(4j).

For example, in the odd-numbered block B3, since 3=(2×2)−1, j is 2. Therefore, shift signals S3 and 54 from the second stage of the shift registers 142 and 144 are supplied to the circuit group of block B3. Sampling signals R5(=(4×2)−3) and R6(=(4×2)−2) correspond to block B3. Similarly, in the even-numbered block B192, since 192=(2×96), j is 96. Therefore, shift signals S191 and S192 from the second stage of the shift registers 142 and 144 are supplied to the circuit group of block B192. Sampling signals R383(=(4×96)−1) and R384 (=4×96) correspond to block B3.

The following enable signals are supplied to the other input terminal of the NAND circuit 1512 to which shift signals S1, S3, S5, . . . , S191 output from the first shift register 142 is supplied.

In other words, the shift signal S(2j−1) output from j-th stage of the first shift register 142 is distributed to two paths so as to correspond to block B(2j−1) and B(2j). When the 5 is an odd number (1, 3, 5, . . . , 95), an enable signal Enb1 is supplied to the other input terminal of the NAND circuit 1512 corresponding to block B(2j−1) and an enable signal Enb2 is supplied to the other input terminal of the NAND circuit 1512 corresponding to block B(2j). Meanwhile, when the j is an odd number (2, 4, 6, . . . , 96), an enable signal Enb3 is supplied to the other input terminal of the NAND circuit 1512 corresponding to block B(2j−1) and an enable signal Enb4 is supplied to the other input terminal of the NAND circuit 1512 corresponding to block B(2j).

On the other hand, the following enable signals are supplied to the other input terminal of the NAND circuit 1512 to which shift signals S2, S4, S6, . . . , S192 output from the first shift register 144 is supplied.

In other words, the shift signal S(2j) output from j-th stage of the second shift register 144 is distributed in the following manner. When the j is an odd number (1, 3, 5, . . . , 95), an enable signal Enb1 is supplied to the other input terminal of the NAND circuit 1512 corresponding to block B(2j−1) and an enable signal Enb2 is supplied to the other input terminal of the NAND circuit 1512 corresponding to block B(2j). Meanwhile, when the j is an odd number (2, 4, 6, . . . , 96), an enable signal Enb3 is supplied to the other input terminal of the NAND circuit 1512 corresponding to block B(2j−1) and an enable signal Enb4 is supplied to the other input terminal of the NAND circuit 1512 corresponding to block B(2j).

As shown in FIG. 7, the enable signals Enb1 to Enb4 have the same frequency as the clock signal CLX and are produced by sequentially outputting pulses having widths narrower than ¼ cycle of the clock signal CLX. The phases of the enable signals are shifted by 90 degrees to each other. More specifically, in the first period Sub1 and the second period Sub2 of the horizontal scanning period H, the pulses of the enable signals are sequentially output in the cycle of Enb1->Enb2->Enb3->Enb4(->Enb1). Moreover, the enable signals Enb1 and Enb2 are output in the falling time of the clock signal CLX, and the enable signals Enb3 and Enb4 are output in the rising time of the clock signal CLX.

Hereinafter, a structure of the sampling circuit 160 will be described.

As shown in FIG. 5, the sampling circuit 160 is a collection of N-channel type TFT 165 having a drain connected to the data line 114.

The source of the TFT 165 is connected in the following manner to any one of three image signal lines 162 to which the data signals Vid1 to Vid3 are supplied. More specifically, in the TFT 165 having a drain connected to the q-th data line 114 from the left end of FIG. 5, when the remainder of q divided by 6 is 1 or 3, the source of the TFT 165 is connected to the image signal line 162 to which the data signal Vid1 is supplied. Similarly, when the remainder of q divided by 6 is 3 or 4, the source of the TFT 165 is connected to the image signal line 162 to which the data signal Vid2 is supplied. When the remainder of q divided by 6 is 5 or 0, the source of the TFT 165 is connected to the image signal line 162 to which the data signal Vid3 is supplied.

For example, the source of TFT 165 having a drain connected to the 11-th data line 114 is connected to the image signal line 162 to which the data signal Vid3 is supplied since the remainder of 11 divided by 6 is 5.

Meanwhile, the sampling signals are supplied to the TFT 165 in the following manner.

In other words, the sampling signals R(4j−3) and R(4j−2) are supplied to the odd-numbered block B(2j−1). However, among the data lines 114 of the six columns belonging to the block B(2j−1), the odd-numbered sampling signals R(4j−3) are commonly supplied to the TFT 165 having a drain connected to the odd-numbered data lines. Moreover, the even-numbered sampling signals R(4j−2) are commonly supplied to the TFT 165 having a drain connected to the even-numbered data lines.

In addition, the sampling signals R(4j−1) and R(4j) are supplied to the even-numbered block B(2j). However, among the data lines 114 of the six columns belonging to the block B(2j), the odd-numbered sampling signals R(4j−1) are commonly supplied to the TFT 165 having a drain connected to the odd-numbered data lines. Moreover, the even-numbered sampling signals R(4j) are commonly supplied to the TFT 165 having a drain connected to the even-numbered data lines.

For example, since j=2 in the odd-numbered block B3 (3=(2×2), the sampling signals R5(=(4×2)−3) and R6(=(4×2)−2) are supplied to the block 53. However, among the data lines of the 13th, 14th, 15th, 16th, 17th, 18th columns belonging to the block 53, the odd-numbered sampling signals R3 are commonly supplied to the TFT 165 having a drain connected to the odd-numbered data lines (corresponding to the 13th, 15th, 17th columns). Moreover, the even-numbered sampling signals R4 are commonly supplied to the TFT 165 having a drain connected to the even-numbered data lines (corresponding to the 14th, 16th, 18th columns).

In the sampling circuit 160, among two sampling signals supplied to an arbitrary block, when the odd-numbered sampling signal is charged to an H level, the TFTs 165 on the odd-numbered rows are simultaneously turned on and the data signals Vid1 to Vid3 are sampled into the odd-numbered data lines among the data lines 114 of the six columns belong to the block. Meanwhile, when the even-numbered sampling signal is charged to an H level, the TFTs 165 on the even-numbered rows are simultaneously turned on and the data signals Vid1 to Vid3 are sampled into the even-numbered data lines.

In other words, when any one of two sampling signals supplied to an arbitrary block is charged to an H level, the block is designated. In addition, when the odd-numbered sampling signal is charged to an H level, the data lines of the odd-numbered columns are selected. When the even-numbered sampling signal is charged to an H level, the data lines of the even-numbered columns are selected. In either case, the data signals are sampled into the selected data lines.

Therefore, the shift register group 140, the data line selection circuit 150 and the sampling circuit 160 constitute the data line driving circuit.

Constituent elements of the scan line driving circuit 130, the shift register group 140, the data line selection circuit 150 and the sampling circuit 160 are formed using the manufacturing processes common to the TFTs 116 in the display panel 100, thereby contributing to decrease in size of the entire device or reduction in cost.

Next, an operation of the electro-optical device 1 according to embodiments of the invention will be described.

In this embodiment, the scan control circuit 52 first supplies the transmission start pulse DY to the scan line driving circuit 130 in one frame period. As a result of this supply, as shown in FIG. 6, the scan signals G1, G2, G3, . . . , G864 sequentially and exclusively are charged to an H level at every horizontal scanning period.

Here, description will be made to the horizontal scanning period when the scan signal G1 is charged to an H level. In this frame period, it is assumed that a positive writing operation is performed onto all the pixels.

First, as shown in FIG. 7, the scan control circuit 52 changes the level of the precharge control signal Nrg into an H level at the beginning of the horizontal scanning period H. As a result, the S/P conversion circuit 320 outputs the image data Vd1 to Vd3 specifying a grayscale of black color to three channels independently of the reading operation from the line memory 310. Accordingly, the data signals Vid1 to Vid3 having voltages corresponding to a black color of a positive polarity are supplied to the three image signal lines 162. Meanwhile, when the precharge control signal Nrg is charged to an H level, since the other input terminal of the NAND circuit 1514 in the data line selection circuit 150 is charged to an L level, the output signal from the NAND circuit 1514 is forcibly charged to an H level. As a result, the entire sampling signals R1, R2, R3, R4, . . . , R384 are charged to an H level.

Therefore, the entire TFTs 165 are turned on and the entire data lines 114 of 1st to 1152nd columns are precharged to voltages corresponding to a black color of a positive polarity. Accordingly, the initial state before writing can be arranged.

Thereafter, since the precharge control signal Nrg is charged to an L level, the logical level of the sampling signals are defined by the shift signals and the enable signals.

Since the scan control circuit 52 supplies the transmission start pulse DX1 at the beginning of the first period Sub 1 of the horizontal scanning period H, the shift signals S1, S3, S5, . . . , S191 from the first shift register 142 are produced by sequentially delaying the transmission start pulse DX1 by the half cycle of the clock signal CLX. In addition, the scan control circuit 52 outputs the enable signals Enb1 and Enb2 before and after the falling time of the clock signal CLX and outputs the enable signals Enb3 and Enb4 before and after the rising time of the clock signal CLX.

In addition, in the first period Sub1, the sampling signal (4j−3) supplied to the odd-numbered block B(2j−1) (wherein j is an odd number) is produced by pulling the pulses of the shift signals S(2j−1) from the first shift register 142 in synchronism with the pulses of the enable signal Enb1. The sampling signal (4j−1) supplied to the even-numbered block B(2j) (wherein j is an odd number) is produced by pulling the pulses of the shift signals S(2j−1) in synchronism with the pulses of the enable signal Enb2. The sampling signal (4j−3) supplied to the odd-numbered block B(2j−1) (wherein j is an even number) is produced by pulling the pulses of the shift signals S(2j−1) in synchronism with the pulses of the enable signal Enb3. The sampling signal (4j−1) supplied to the even-numbered block B(2j) (wherein j is an even number) is produced by pulling the pulses of the shift signals S(2j−1) in synchronism with the pulses of the enable signal Enb4.

Moreover, in the first period Sub1, since the transmission start pulse DX2 is not supplied to the second shift register 144, the shift operation is not performed. Therefore, the shift signals S2, S4, S6, . . . , S192 remains at an L level.

Therefore, when the clock signals CLX corresponding to at least 98 cycles are output after the transmission start pulse DX1 is supplied in the first period Sub1, the odd-numbered sampling signals R1, R3, R5, R7 . . . , R383 are sequentially and exclusively charged to an H level in the first period Sub1.

Meanwhile, before the scan signal G1 is charged to an H level, the image data Vin corresponding to the 1st columns pixels of the 1st, 2nd, 3rd, 4th, . . . , 1152nd rows are sequentially supplied from an upper level apparatus and stored in the line memory 310.

Figure 8:
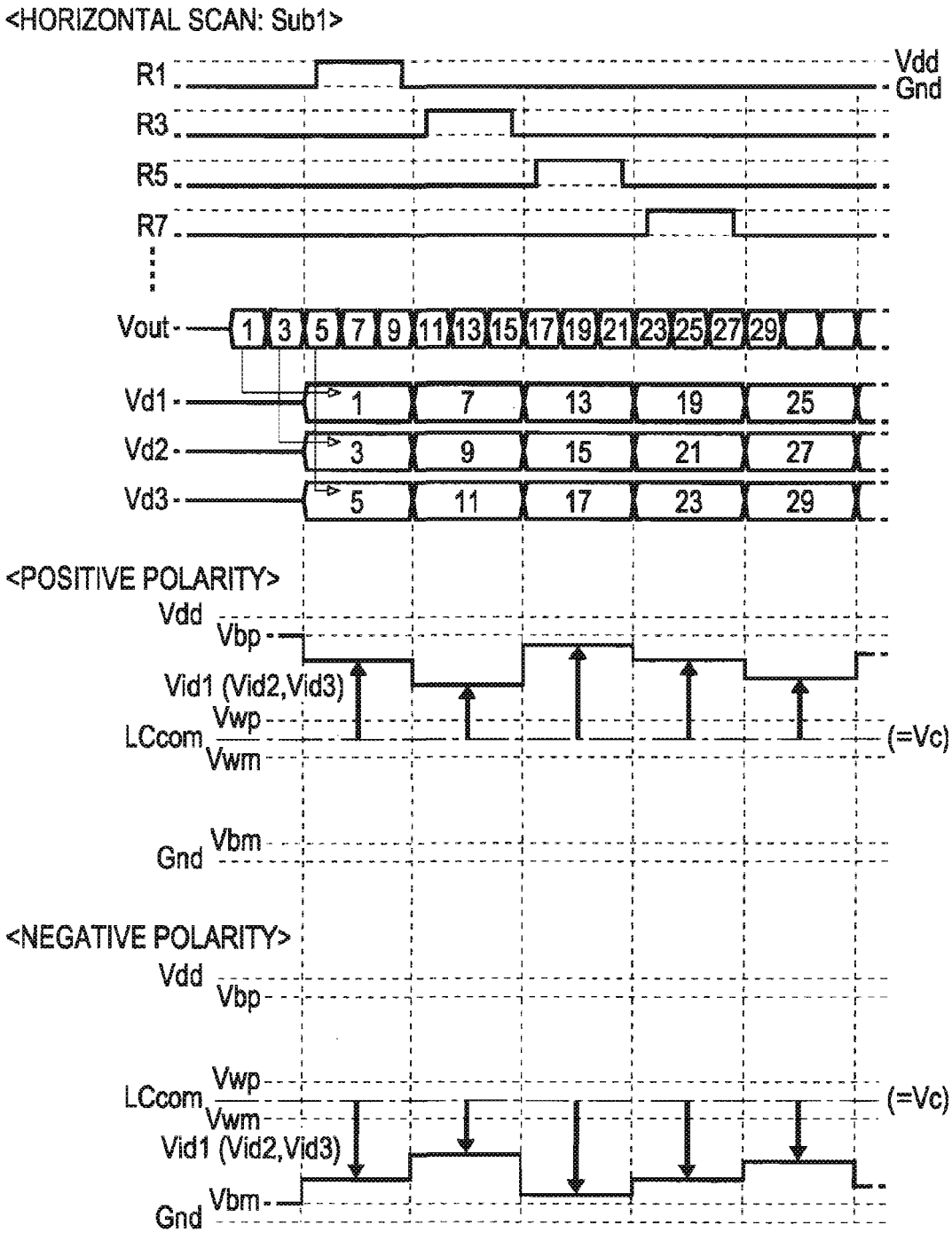
FIG. 8 is a timing diagram for explaining an operation of writing data signals in the electro-optical device.

More specifically, as shown in FIG. 8, the scan control circuit 52 start to read out the image data corresponding to the 1st column pixels of the odd-numbered rows from the line memory 310 right before the sampling signal R1 is charged to an H level in the first period Snb1 of the horizontal scanning period H when the scan signal G1 is charged to an H level (strictly speaking, right before the enable signal Enb1 is charged to an H level, since the period when the sampling signal R1 is charged to an H level corresponds to the period when the enable signal Enb1 is charged to an H level in the period when the shift S1 is charged to an H level). In other words, in the first period Sub1, the image data Vout corresponding to the 1st column pixels of the 1st, 3rd, 5th, 7th, 9th, . . . , 1151st rows are sequentially read out.

The read image data Vout is expanded to three times on the temporal axis by the S/P conversion circuit 320 in synchronism with the period when the sampling signal R1 is charged to an H level. The expanded image data corresponding to 1st, 3rd, 5th rows are distributed in the order of the image data Vd1, Vd2, Vd3, respectively. The distributed image data Vd1, Vd2, Vd3 are converted into analog signals by the D/A conversion circuit group 330 and into positive polarity signals by the polarity inversion circuit 340, thereby being output as the data signals Vid1, Vid2, Vid3, respectively.

As a result, the data signal Vid1 is charged to a positive polarity voltage corresponding to the grayscale of the pixel 110 positioned at the 1st column and 1st row. Similarly, the data signals Vid2 and Vid3 are charged to a positive polarity voltage corresponding to the grayscale of the pixels 110 positioned at the 1st column and 3rd row and the 1st column and 5th row, respectively. The previous data signals Vid1, Vid2, Vid3 are changed to the precharge voltage.

When the sampling signal R1 is charged to an H level, the TFTs 165 corresponding to the odd-numbered 1st, 3rd, 5th rows of the 1st to 6th rows belonging to the block B1 is turned on. Therefore, the data signal Vid1 having a positive polarity corresponding to the grayscale of the pixel 110 of the 1st column and 1st row is sampled into the 1st rows of the data lines 114. Similarly, the data signals Vid2 and Vid3 having positive polarities corresponding to the grayscale of the pixel 110 of the 1st column and 3rd row and the 1st column and 5th row are sampled into the 3rd and 5th rows of the data lines 114.

Since the scan signal G1 is charged to an H level, the entire TFTs 116 having a gate connected to the 1st rows of the scan lines 112 is turned on. Therefore, the data signal Vid1 sampled into the 1st rows of the data lines 114 is applied to the pixel electrode 118 of the 1st column and 1st row corresponding to intersections between the 1st columns of the scan lines 112 and the 1st rows of the data lines 114. Similarly, the data signals Vid2 and Vid3 sampled into the 3rd and 5th rows of the data lines 114 are applied to the pixel electrodes 118 of the 1st column and 3rd row and the 1st column and 5th row.

Subsequent to the sampling signal R1, the sampling signal R3 is charged to an H level in the first period Sub1. The image data Vout corresponding to the 1st column pixels 110 of the 7th, 9th, 11st rows are expanded to three times on the temporal axis in synchronism with the period when the sampling signal R3 is charged to an H level. The expanded image data are distributed into the image data Vd1, Vd2, Vd3, respectively. The distributed image data Vd1, Vd2, Vd3 are converted into analog signals having a positive polarity and output as the data signals Vid1, Vid2, Vid3, respectively. As a result, the data signal Vid1 is charged to a positive polarity voltage corresponding to the grayscale of the pixel 110 positioned at the 1st column and 7th row. Similarly, the data signals Vid2 and Vid3 are charged to a positive polarity voltage corresponding to the grayscale of the pixels 110 positioned at the 1st column and 9th row and the 1st column and 11st row, respectively.

When the sampling signal R3 is charged to an H level, the TFTs 165 corresponding to the odd-numbered 7th, 9th, 11st rows of the 1st to 6th rows belonging to the block B2 is turned on. Therefore, the data signal Vid1 having a positive polarity corresponding to the grayscale of the pixel 110 of the 1st column and 7th row is sampled into the 7th rows of the data lines 114. Similarly, the data signals Vid2 and Vid3 having positive polarities corresponding to the grayscale of the pixel 110 of the 1st column and 9th row and the 1st column and 11st row are sampled into the 9th and 11st rows of the data lines 114. Therefore, the data signal Vid1 sampled into the 7th rows of the data lines 114 is applied to the pixel electrode 118 of the 1st column and 7th row. Similarly, the data signals Vid2 and Vid3 sampled into the 9th and 11st rows of the data lines 114 are applied to the pixel electrodes 118 of the 1st column and 9th row and the 1st column and 11st row.

In the same manner, in the first period Sub1, the odd-numbered sampling signals R5, R7, R9, . . . , R383 are sequentially charged to an H level, the blocks B3, B4, B5, . . . , B192 are designated, the data signals Vid1, Vid2, Vid3 are sampled into the odd-numbered rows of the data lines 114 belonging to the designated blocks, whereby an operation of writing to the pixel electrode is performed.

Next, operations in the second period Sub2 of the horizontal scanning period H will be described.

The scan control circuit 52 supplies the transmission start pulse DX2 at the beginning of the first period Sub 1 of the horizontal scanning period H. Therefore, the shift signals S2, S4, S6, . . . , S192 from the second shift register 144 are produced by sequentially delaying the transmission start pulse DX2 by the half cycle of the clock signal CLX. In addition, in the second period Sub2, the enable signals Enb1, Enb2, Enb3 and Enb4 are output in the same manner as the first period Sub1.

In addition, in the second period Sub2, the sampling signal (4j−2) supplied to the odd-numbered block B(2j−1) (wherein j is an odd number) is produced by pulling the pulses of the shift signals S(2j) from the second shift register 144 in synchronism with the pulses of the enable signal Enb1. The sampling signal (4j) supplied to the even-numbered block B(2j) (wherein j is an odd number) is produced by pulling the pulses of the shift signals S(2j) in synchronism with the pulses of the enable signal Enb2. The sampling signal (4j−2) supplied to the odd-numbered block B(2j−1) (wherein j is an even number) is produced by pulling the pulses of the shift signals S(2j) in synchronism with the pulses of the enable signal Enb3. The sampling signal (4j) supplied to the even-numbered block B(2j) (wherein j is an even number) is produced by pulling the pulses of the shift signals S(2j) in synchronism with the pulses of the enable signal Enb4.

Moreover, in the second period Sub2, since the transmission start pulse DX1 has been transmitted by the second shift register 142, the shift operation is not performed. Therefore, the shift signals S1, S3, S5, . . . , S191 remains at an L level.

Therefore, when the clock signals CLX corresponding to at least 98 cycles are output after the transmission start pulse DX2 is supplied in the second period Sub2, the even-numbered sampling signals R2, R4, R6, R8, . . . , R384 are sequentially and exclusively charged to an H level in the second period Sub2.

Figure 9:
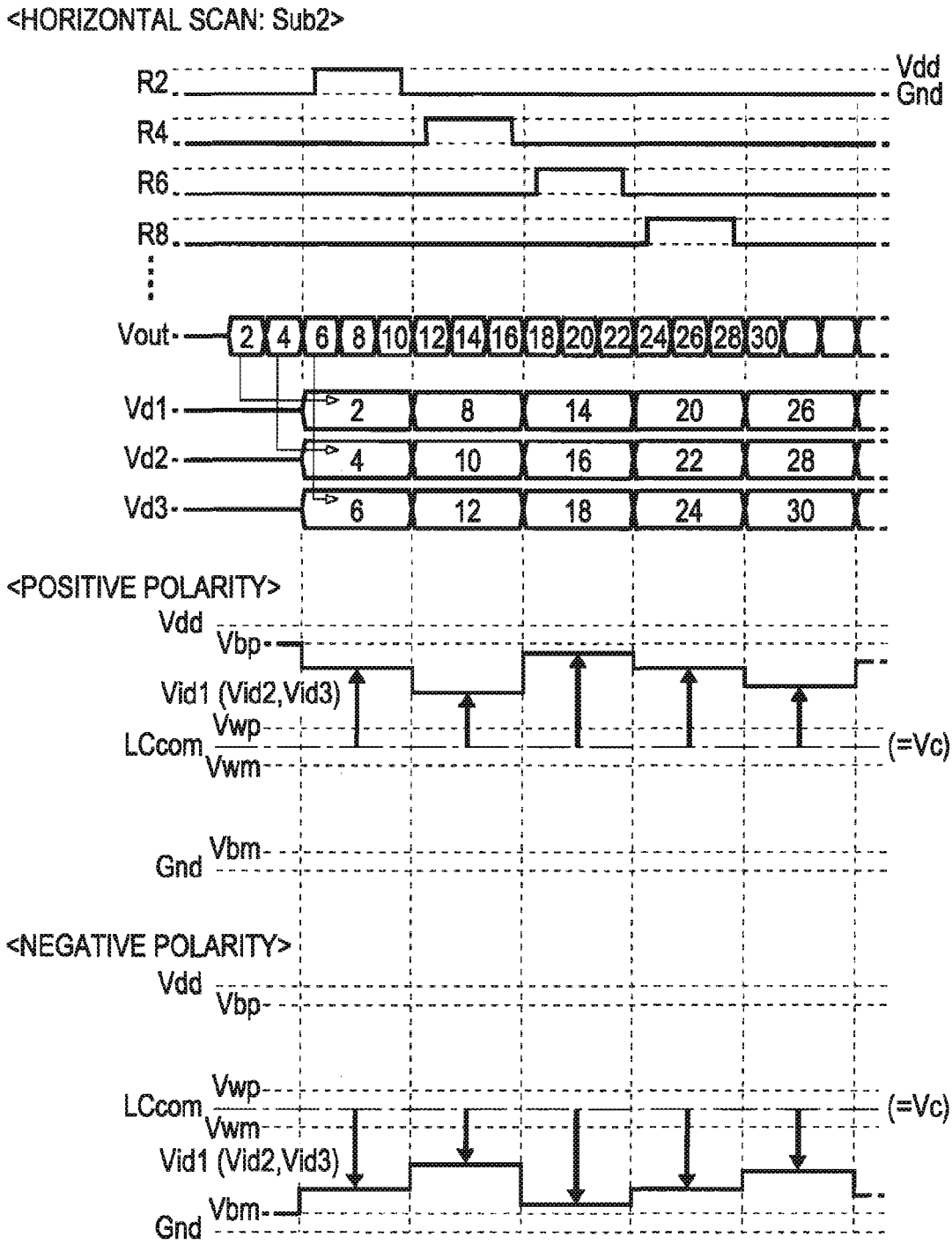
FIG. 9 is a timing diagram for explaining an operation of writing data signals in the electro-optical device.

More specifically, as shown in FIG. 9, the scan control circuit 52 start to read out the image data corresponding to the 1st column pixels of the even-numbered rows from the line memory 310 right before the sampling signal R2 is charged to an H level in the second period Snb2 when the scan signal G2 is charged to an H level (strictly speaking, right before the enable signal Enb1 is charged to an H level, since the period when the sampling signal R2 is charged to an H level corresponds to the period when the enable signal Enb1 is charged to an H level in the period when the shift S2 is charged to an H level). In other words, in the second period Sub2, the image data Vout corresponding to the 1st column pixels of the 2nd, 4th, 6th, 8th, 10th, . . . , 1152nd rows are sequentially read out.

The read image data Vout is expanded to three times on the temporal axis by the S/P conversion circuit 320 in synchronism with the period when the sampling signal R2 is charged to an H level. The expanded image data corresponding to 2nd, 4th, 6th rows are distributed in the order of the image data Vd1, Vd2, Vd3, respectively. The distributed image data Vd1, Vd2, Vd3 are converted into analog signals by the D/A conversion circuit group 330 and into positive polarity signals by the polarity inversion circuit 340, thereby being output as the data signals Vid1, Vid2, Vid3, respectively.

When the sampling signal R2 is charged to an H level, the TFTs 165 corresponding to the even-numbered 2nd, 4th, 6th rows of the 1st to 6th rows belonging to the block B1 is turned on. Therefore, the data signal Vid1 having a positive polarity corresponding to the grayscale of the pixel 110 of the 1st column and 2nd row is sampled into the 2nd rows of the data lines 114. Similarly, the data signals Vid2 and Vid3 having positive polarities corresponding to the grayscale of the pixel 110 of the 1st column and 4th row and the 1st column and 6th row are sampled into the 4th and 6th rows of the data lines 114. In the second period Sub2, the scan signal G1 has been charged to an H level from the first period Sub1. Therefore, the data signal Vid1 sampled into the 2nd rows of the data lines 114 is applied to the pixel electrode 118 of the 1st column and 2nd row corresponding to intersections between the 1st columns of the scan lines 112 and the 2nd rows of the data lines 114. Similarly, the data signals Vid2 and Vid3 sampled into the 4th and 6th rows of the data lines 114 are applied to the pixel electrodes 118 of the 1st column and 4th row and the 1st column and 6th row.

In the same manner, in the second period Sub2, the even-numbered sampling signals R4, R6, R8, R10, . . . , R384 are sequentially charged to an H level, the blocks B2, B3, B4, B5, . . . , B192 are designated, the data signals Vid1, Vid2, Vid3 are sampled into the even-numbered rows of the data lines 114 belonging to the designated blocks, whereby an operation of writing to the pixel electrode is performed.

Hereinabove, descriptions have been made to the operations in the horizontal scanning period where the scan signal G1 is charged to an H level. However, in the case of the horizontal period where the scan signals GA, G3, . . . , G864 are charged to an H level, similar operations are performed onto the rows corresponding to the selected scan lines 112. In this manner, the operations of writing a positive polarity voltage corresponding to the grayscale of the pixels to the entire pixels of the 1st to 864th rows are completed with respect to the one frame period.

In the subsequent frame period, a similar writing operation is performed onto the pixels of the 1st to 864th rows. However, in this embodiment, since the polarity is inverted at every frame period, an operation of writing a negative polarity voltage corresponding to the grayscale of the pixels are preformed to the entire pixels.

To describe the voltage of the data signals Vid1 to Vid3, in the first period Sub1, the polarity of the data signals are converted and output into a polarity designated by the polarity designation signal Pol in synchronism with the phase-developing operation by the S/P conversion circuit 320 as shown in FIG. 8 (see FIG. 9 in the case of the second period Sub2).

When it is designated to write a positive polarity, the voltage of the data signal Vid1 is shifted from the reference voltage Vc by the amount corresponding to the grayscale of the pixel within the range between a voltage Vwp corresponding to a white color and a voltage Vbp corresponding to a black color. Meanwhile, when it is designated to write a negative polarity, the voltage of the data signal Vid1 is shifted from the reference voltage Vc by the amount corresponding to the grayscale of the pixel within the range between a voltage Vwm corresponding to a white color and a voltage Vbm corresponding to a black color. In the drawings, a positive polarity and a negative polarity are denoted by ↑ and ↓, respectively. Here, the positive polarity voltage Vwp (and Vbp) and the negative polarity voltage Vwm (and Vbm) are symmetrical about the reference voltage Vc.

Figure 10:
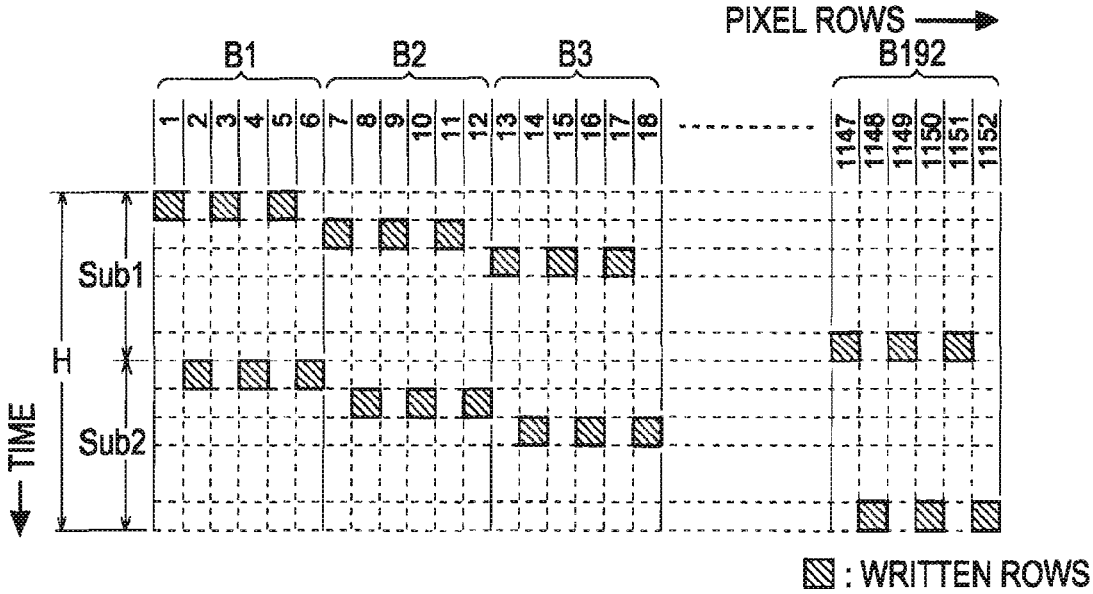
FIG. 10 is a diagram for explaining a writing operation in the electro-optical device.
Figure 11:
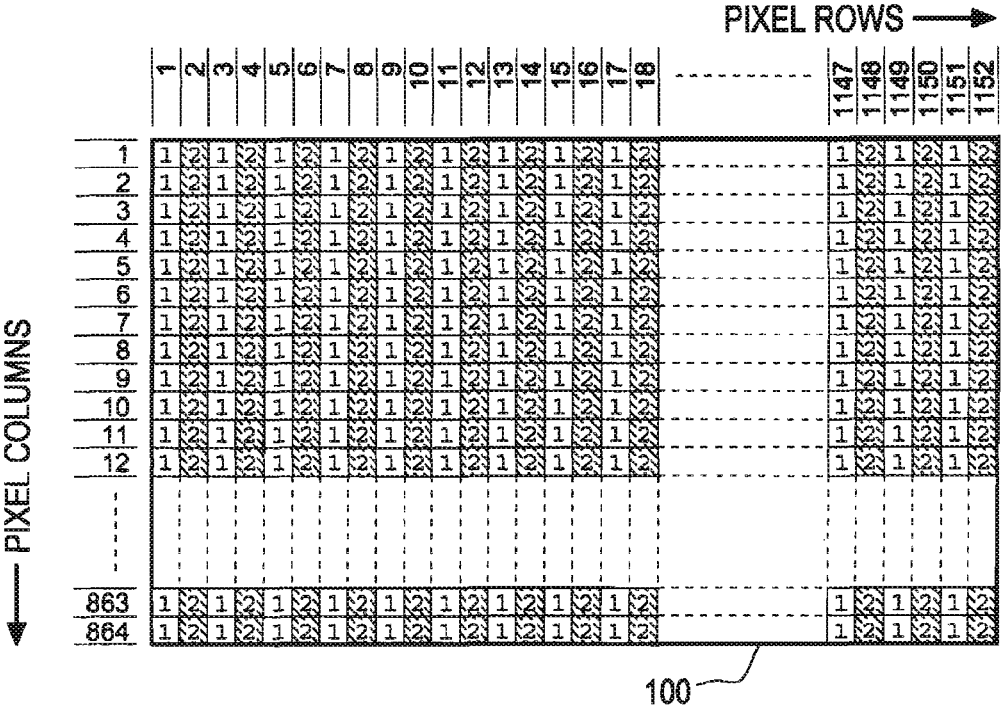
FIG. 11 is a diagram showing a written state in the electro-optical device.

In this embodiment, the H level of the scan signals and the sampling signals corresponds to the source voltage Vcc and the T level corresponds to the ground potential. Moreover, the vertical axis in FIGS. 8 and 9 representing the voltage of the data signals are enlarged compared with voltage waveforms of other logical signals According to this embodiment, as shown in FIG. 10, in the first period Sub1 of the horizontal scanning period H where any one of the scan lines is selected, the blocks B1, B2, B3, . . . , B192 are designated, and an operation of writing voltage corresponding to the grayscale is performed onto the odd-numbered rows of the designated blocks. Meanwhile, in the second period Sub2, the blocks B1 B2, B3, . . . , B192 are designated, and an operation of writing voltage corresponding to the grayscale is performed onto the even-numbered rows of the designated blocks. As a result, in this embodiment, considering the entire screen of the display region 100, as shown in FIG. 11, pixels (denoted by "1" in FIG. 11 since the writing operation is performed in the first period Sub1) to which the writing operation is performed and pixels (denoted by "2" in FIG. 11 since the writing operation is performed in the second period Sub2) to which the writing operation is not performed are alternatingly appearing at every one rows in pixels adjacent to the right and left side of the written rows.

Figure 30:
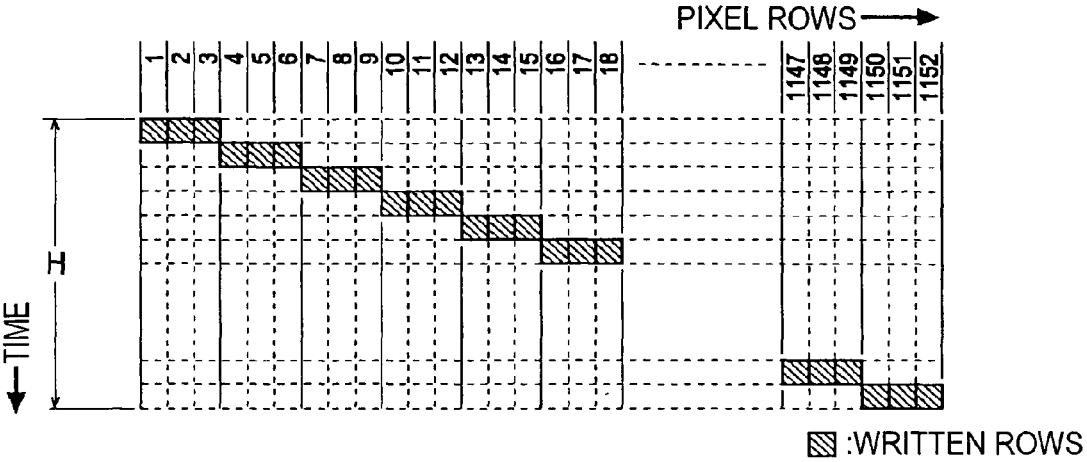
FIG. 30 Related Art
FIG. 30 is a diagram for explaining a writing operation according to a known art.
Figure 31:
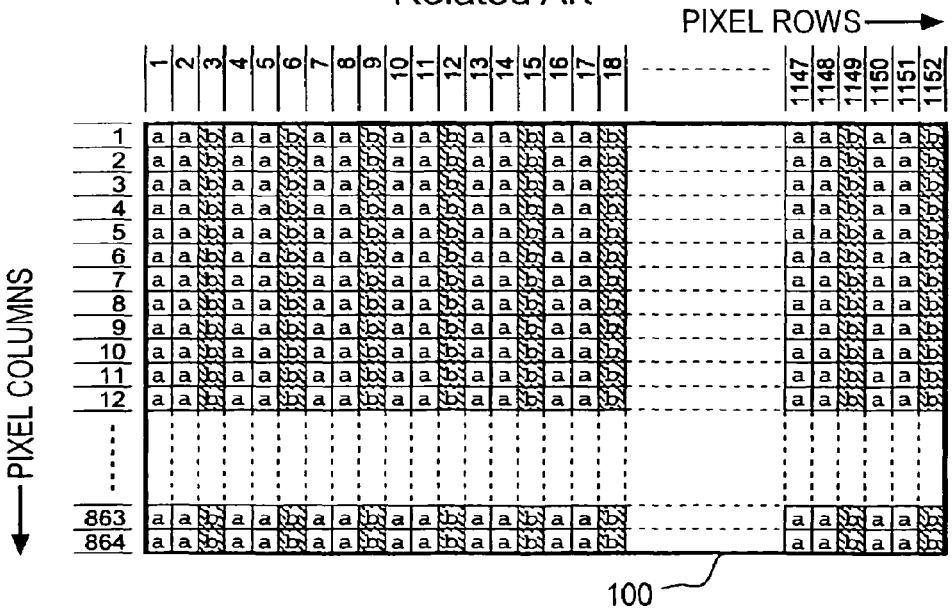
FIG. 31 Related Art
FIG. 31 is a diagram showing a written state related to the known art.

On the other hand, as shown in FIG. 30, in the case of three-phase-developed driving method according to the known art, in the horizontal scanning period H where any one of the scan lines is selected, the blocks B1, B2, B3, . . . , B192 are designated, and an operation of writing voltage corresponding to the grayscale is performed onto only three rows of the designated blocks. As a result, in the known art, as shown in FIG. 31, pixels (denoted by "b") to which the writing operation is performed and pixels (denoted by "a") to which the writing operation is not performed are alternatingly appearing in pixels adjacent to the right side of the written rows at every three rows, which is a phase-developed driving number. Although the final 1152-th row is denoted by "b" in FIG. 31 for the purpose of convenience, strictly speaking, the final 1152-th row should be denoted by "a" since there is no pixel adjacent to the right side of the row.

In written pixels where a writing operation is performed to adjacent pixels, since it is possible to consider the influence of the writing operation on the written voltage of the pixel, a subtle difference in the grayscale may be visible even when it is desired to display the written pixels where the writing operation is performed to an adjacent pixel and the written pixels where the writing operation is not performed with the same grayscale.

In the known art, since the grayscale difference appears at every three row, the difference is easily observed. However, in this embodiment, since the grayscale difference alternatingly appears in the odd-numbered rows and the even-numbered rows, i.e., at every one rows, it is possible to make the grayscale difference due to the phase-developing method invisible.

in this embodiment, since the 1st rows do not have pixels adjacent to the left side of the row, the influence of the writing operation may be different from those odd-numbered rows, such as 3rd, 5th, . . . , 1151-th rows (written pixels where the writing operation is performed to the pixels adjacent to the right and left side of the rows). In this case, the 1st rows may be shielded from light as a dummy region.

Second Embodiment

Hereinafter, a second embodiment of the invention will be described. In the first embodiment, since the grayscale difference alternatingly appears in the odd-numbered rows and the even-numbered rows, i.e., at every one rows, it can be said that the grayscale difference is hard to observe compared with the known art. However, the written pixels where the writing operation is performed to the adjacent pixels and the written pixels where the writing operation is not performed are arranged in the same rows, may be considered as a vertical stripe pattern.

Figure 13:
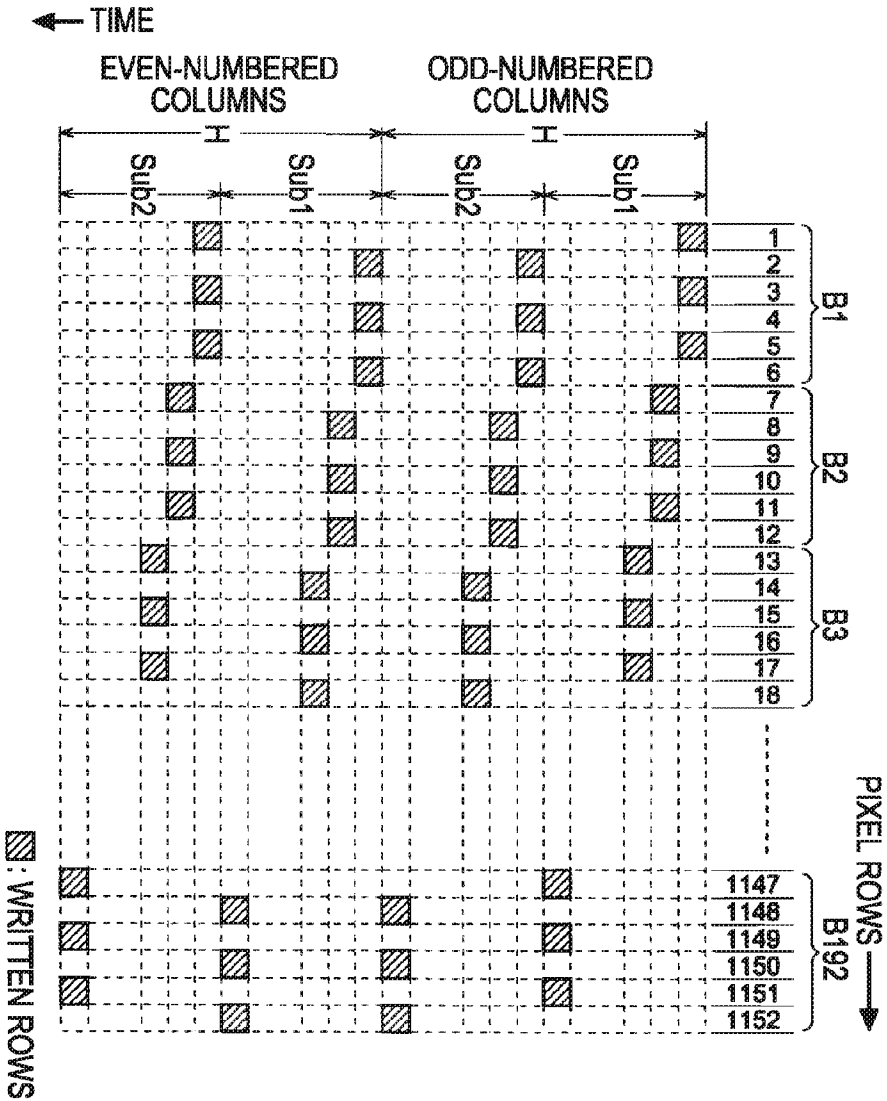
FIG. 13 is a diagram for explaining signals related to the second embodiment.

Therefore, in the second embodiment, as shown in FIG. 13, in the first period Sub1 of the horizontal scanning period H where the odd-numbered columns (1, 3, 5, . . . , 863) of the scan lines are selected, similarly to the first embodiment, the blocks B1, B2, B3, . . . , B192 are designated, and an operation of writing voltage corresponding to the grayscale is performed onto the odd-numbered rows of the designated blocks. In the second period Sub2, the blocks B1, B2, B3, . . . , B192 are designated, and an operation of writing voltage corresponding to the grayscale is performed onto the odd-numbered rows of the designated blocks. To the contrary, in the first period Sub1 of the horizontal scanning period H where the even-numbered columns (2, 4, 6, . . . , 864) of the scan lines, an operation of writing voltage corresponding to the grayscale is performed onto the even-numbered rows of the designated blocks. In the second period Sub2, an operation of writing voltage corresponding to the grayscale is performed onto the odd-numbered rows of the designated blocks.

Figure 14:
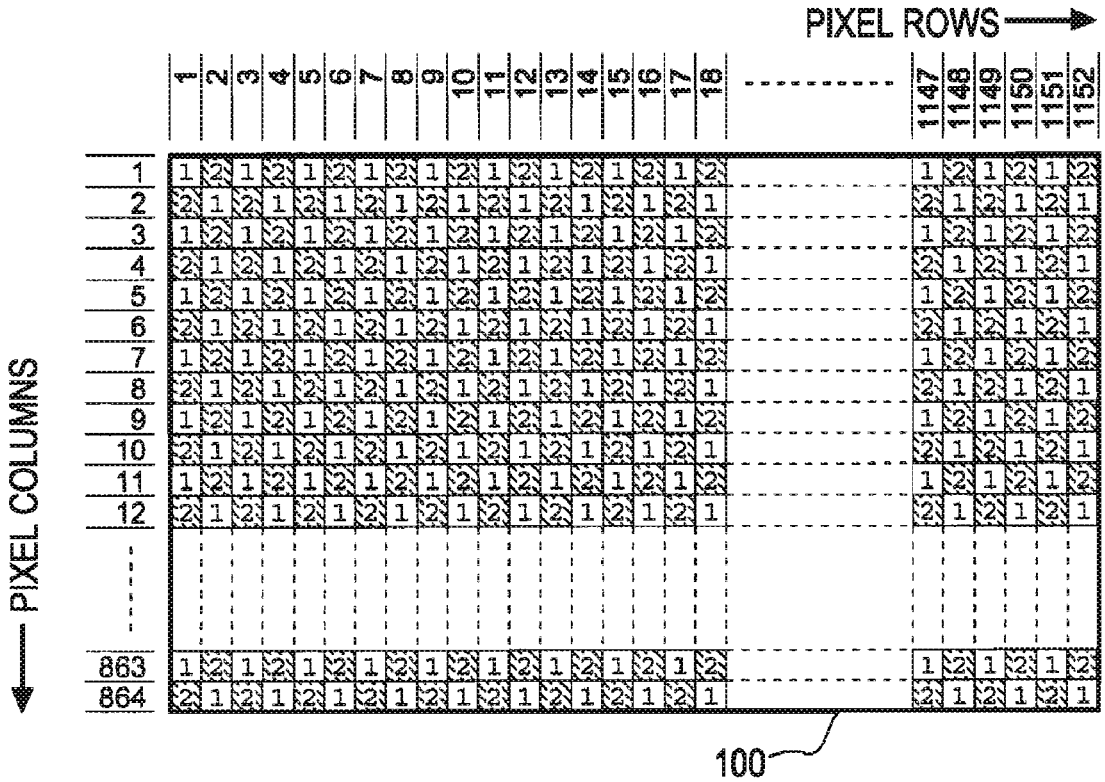
FIG. 14 is a diagram for explaining a signal state related to the second embodiment.

As a result, in the second embodiment, considering the entire screen of the display region 100, as shown in FIG. 14, pixels (denoted by "1") to which the writing operation is performed and pixels (denoted by "2") to which the writing operation is not performed are alternatingly appearing at every one rows and columns in pixels adjacent to the right and left side of the written rows.

According to the second embodiment, it is possible to effectively make the grayscale difference due to the phase-developing method invisible compared with the first embodiment.

In the second embodiment, in the horizontal scanning period where the even-numbered columns of the scan lines are selected, the scan control circuit 52 outputs the transmission start pulse DX2 in the first period Sub1 and outputs the transmission start pulse DX1 in the first period Sub2. As a result, the operation of writing voltage is performed onto the even-numbered rows of the designated blocks in the first period Sub1, and the operation of writing voltage is performed onto the odd-numbered rows of the designated blocks in the second period Sub2.

In the second embodiment, it is needless to say that the odd-numbered columns and the even-numbered columns may be changed in the above-mentioned descriptions

Third Embodiment

Hereinafter, a third embodiment according to the invention will be described.

Figure 15A:
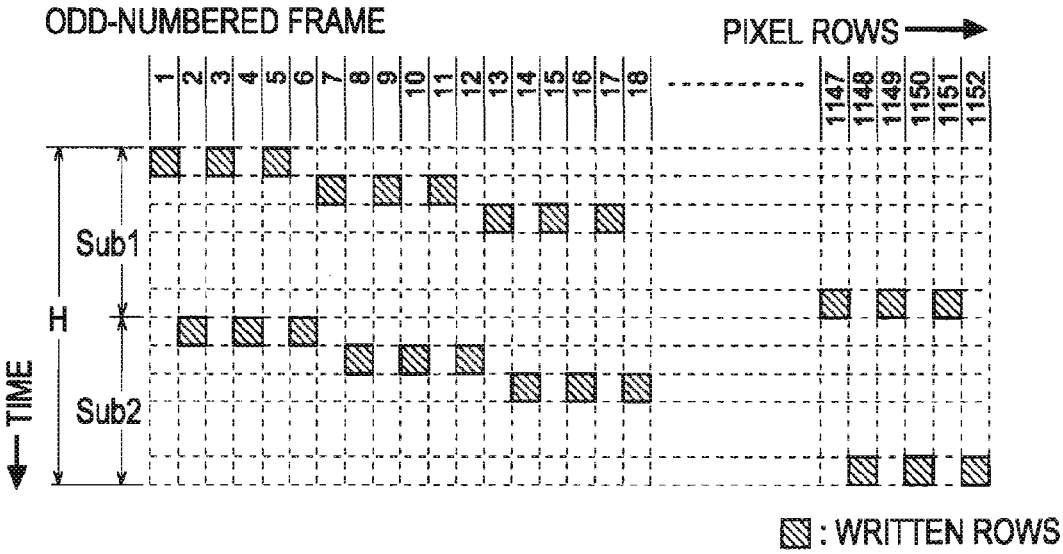
FIGS. 15A and 15B are diagrams for explaining signals related to a third embodiment of the invention.
Figure 15B:
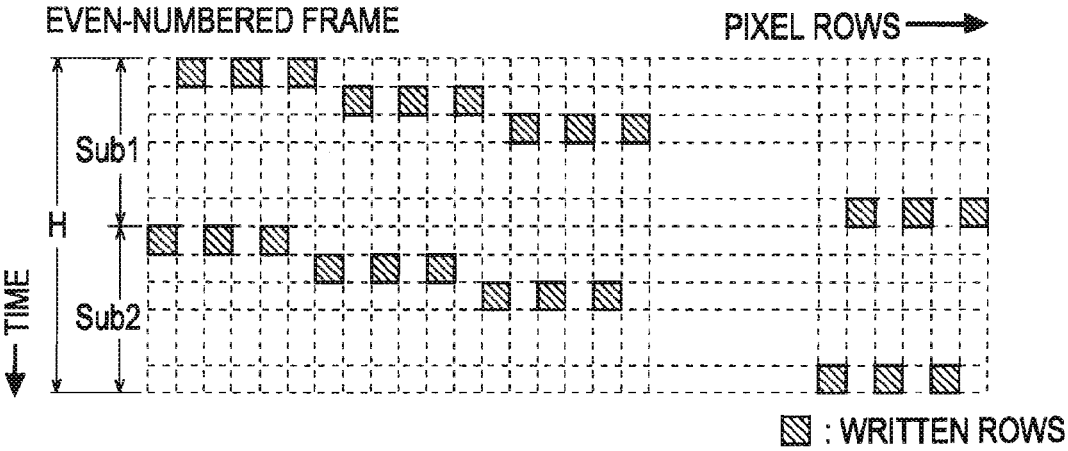

In the third embodiment, as shown in FIG. 11A, for example, in the horizontal scanning period H of an n-th frame (n is an odd number) where the 1st columns of the scan lines are selected, similarly to the first embodiment, an operation of writing voltage corresponding to the grayscale is performed onto the odd-numbered rows of the sequentially designated blocks in the first period Sub1, and an operation of writing voltage corresponding to the grayscale is performed onto the even-numbered rows of the sequentially designated blocks in the second period Sub2. In this case, contrary to the first embodiment, as shown in FIG. 15B, in the horizontal scanning period H of a next (n+1)-th frame (even-numbered frame) where the 1st columns of the scan lines are selected, an operation of writing voltage corresponding to the grayscale is performed onto the even-numbered rows of the sequentially designated blocks in the first period Sub1, and an operation of writing voltage corresponding to the grayscale is performed onto the odd-numbered rows of the sequentially designated blocks in the second period Sub2.

As a result, in the third embodiment, considering the entire screen of the display region 100, as shown in FIG. 16A in the case of the odd-numbered frame and in FIG. 16B in the case of the even-numbered frame, pixels (denoted by "1") to which the writing operation is performed and pixels (denoted by "2") to which the writing operation is not performed are alternatingly appearing with time in pixels adjacent to the right and left side of the written rows. Accordingly, the grayscale difference in the pixels is equalized when the unit period is set to two frames.

According to the third embodiment, it is possible to further effectively make the grayscale difference due to the phase-developing method invisible compared with the first embodiment.

In the third embodiment, it is needless to say that the odd-numbered columns and the even-numbered columns may be changed in the above-mentioned description.

Fourth Embodiment

Hereinafter, a fourth embodiment according to the invention will be described in the fourth embodiment, the Lime variation considered in the third embodiment is applied to the second embodiment.

Figure 17:
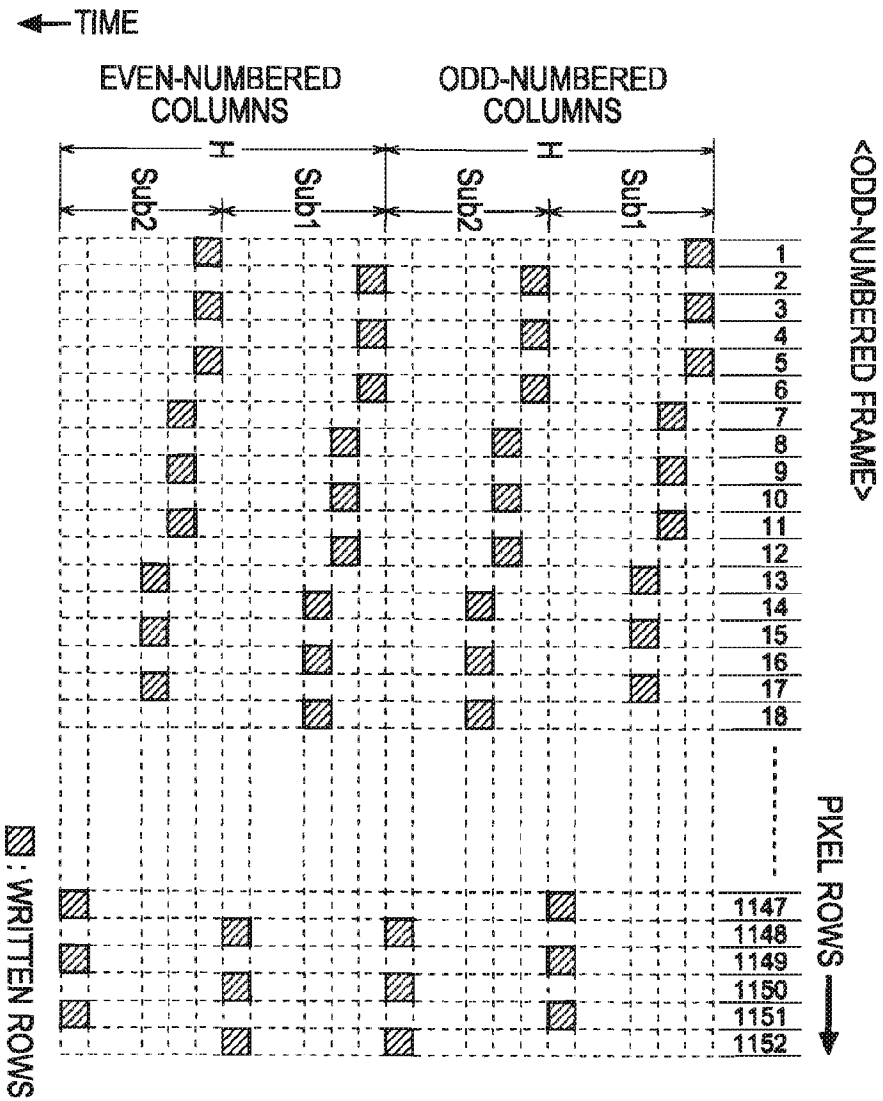
FIG. 17 is a diagram for explaining a writing operation according to a fourth embodiment.
Figure 18:
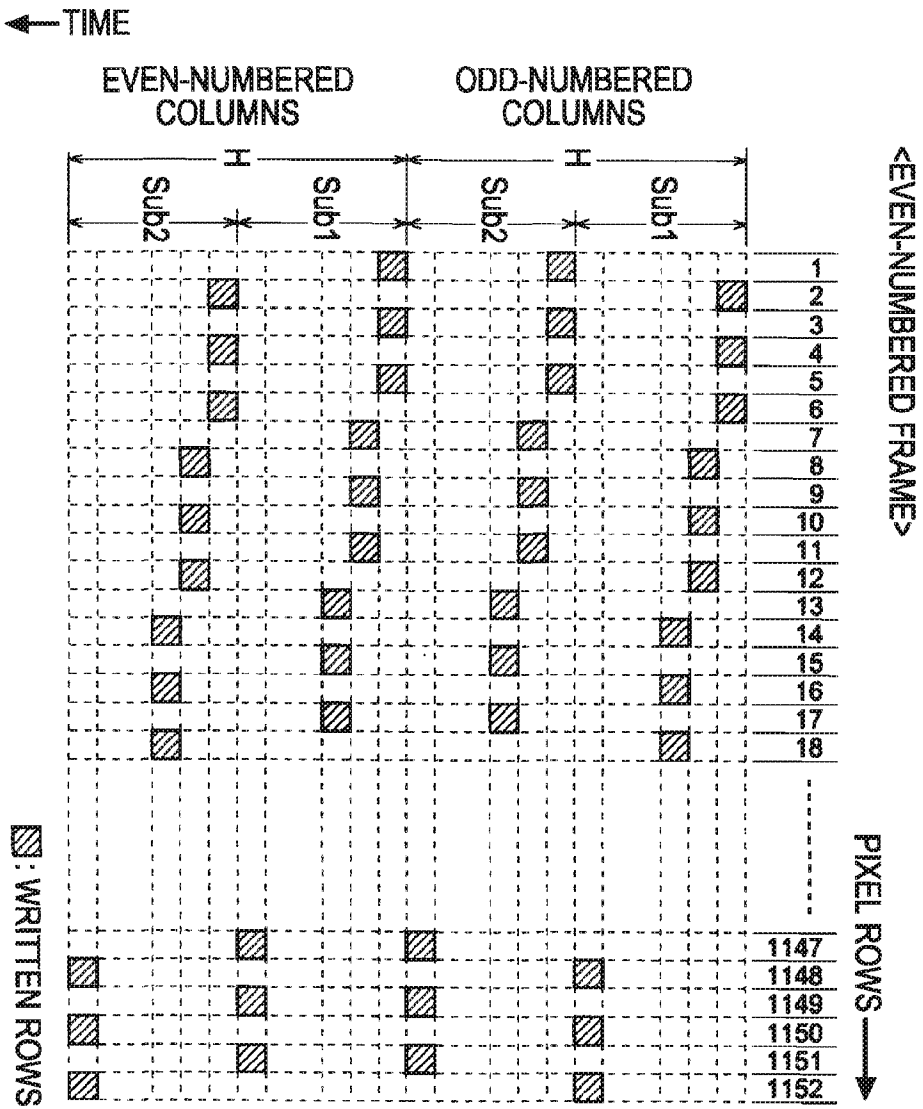
FIG. 18 is a diagram for explaining a writing operation according to the fourth embodiment.

More specifically, in the fourth embodiment, as shown in FIG. 17, in the horizontal scanning period H where the odd-numbered columns of the scan lines are selected over the odd-numbered frames, an operation of writing voltage corresponding to the grayscale is performed onto the odd-numbered rows of the sequentially designated blocks in the first period Sub1, and an operation of writing voltage corresponding to the grayscale is performed onto the even-numbered rows of the sequentially designated blocks in the second period Sub2. In the subsequent horizontal scanning period H where the even-numbered columns of the scan lines are selected, an operation of writing voltage corresponding to the grayscale is performed onto the even-numbered rows of the designated blocks in the first period Sub1, and an operation of writing voltage corresponding to the grayscale is performed onto the odd-numbered rows of the designated blocks in the second period Sub2. In this case, as shown in FIG. 18, in the subsequent horizontal scanning period H where the odd-numbered columns of the scan lines are selected over the even-numbered frames, an operation of writing voltage corresponding to the grayscale is performed onto the even-numbered rows of the sequentially designated blocks in the first period Sub1, and an operation of writing voltage corresponding to the grayscale is performed onto the odd-numbered rows of the sequentially designated blocks in the second period Sub2. In the subsequent horizontal scanning period H where the even-numbered columns of the scan lines are selected, an operation of writing voltage corresponding to the grayscale is performed onto the odd-numbered rows of the designated blocks in the first period Sub1, and an operation of writing voltage corresponding to the grayscale is performed onto the even-numbered rows of the designated blocks in the second period Sub2.

As a result, in the fourth embodiment, considering the entire screen of the display region 100, as shown in FIG. 19A in the case of the odd-numbered frame and in FIG. 198 in the case of the even-numbered frame, pixels (denoted by "1") to which the writing operation is performed and pixels (denoted by "2") to which the writing operation is not performed appear in pixels adjacent to the right and left side of the written rows in such a manner that the two groups of pixels are alternating at every one rows and columns in the same frame and at every temporally adjacent frames. Accordingly, the grayscale difference in the pixels is equalized when the unit period is set to two frames.

According to the fourth embodiment, it is possible to further effectively make the grayscale difference due to the phase-developing method invisible compared with the second and third embodiments.

In the fourth embodiment, it is needless to say that the odd-numbered columns and the even-numbered columns may be changed in the above-mentioned description.

Fifth Embodiment

Hereinafter, a fifth embodiment according to the invention will be described.

In the fifth embodiment, the time variation considered in the third embodiment is applied to the region scanning method disclosed in JP-A-2004-177930, for example.

Figure 20:
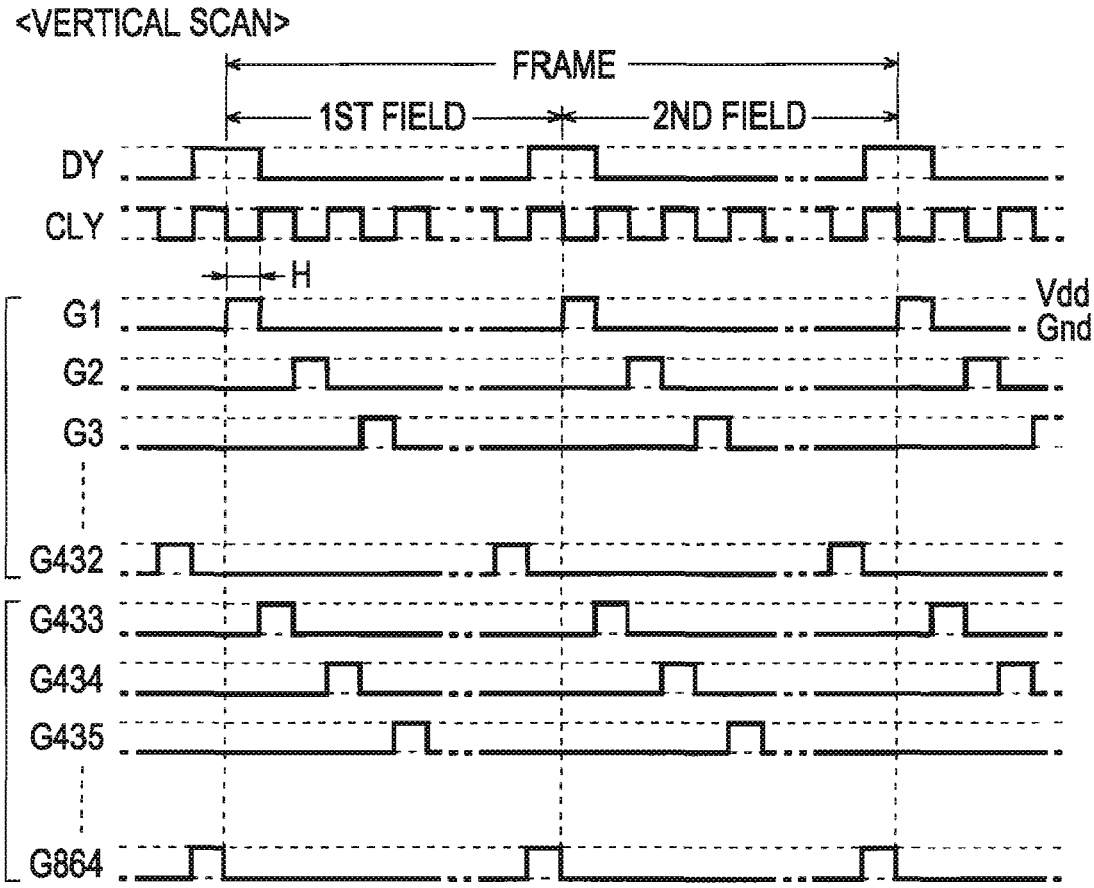
FIG. 20 is a timing diagram for explaining an operation of a vertical scanning according to a fifth embodiment.

Since details of the region scanning method are described in JP-A-2004-177930, detailed descriptions on this method will be omitted. To briefly describe, the display region 100 is logically divided into an upper region (a first region) corresponding to the 1st to 432nd columns of the scan lines and a lower region (a second region) corresponding to the 433rd to 864th columns of the scan lines. Moreover, as shown in FIG. 20, a frame is divided into first and second fields, and the scan lines in the first and second fields are selected in the order of 1st, 433rd, 2nd, 434th, 3rd, 435th, . . . , 432nd, 864th columns, i.e., in a manner that the upper region and the lower region are alternating with each other and in the downward direction in each region.

The logical division of the display region does not mean a physical division of the display region. It means that the display region can be divided in view of the scanning order for the purpose of convenience even though not divided in a physical perspective of the display region.

According to the region scanning method, in the first field, an operation of writing a positive polarity voltage is performed onto the pixels belonging to the upper region, and an operation of writing a negative polarity voltage is performed onto the pixels belonging to the lower region. In this case, in the second field, an operation of writing a negative polarity voltage is performed onto the pixels belonging to the upper region, and an operation of writing a positive polarity voltage is performed onto the pixels belonging to the lower region. As a result, since the ratio between the positive polarity and the negative polarity among those sampled into the data lines after the writing operation becomes almost 50% independently of the columns of the scan lines contributing the writing operation, the inclination of the voltage polarity of the data lines can be removed thanks to the position of the position of the columns of the scan lines, thereby equalizing the display quality.

In the region scanning method, since the data signals are supplied to each of the first and second fields, the line memory 310 in FIG. 1 is substituted by a frame memory capable of storing the image data Vin corresponding to the one frame period supplied from the upper level apparatus.

Figure 21:
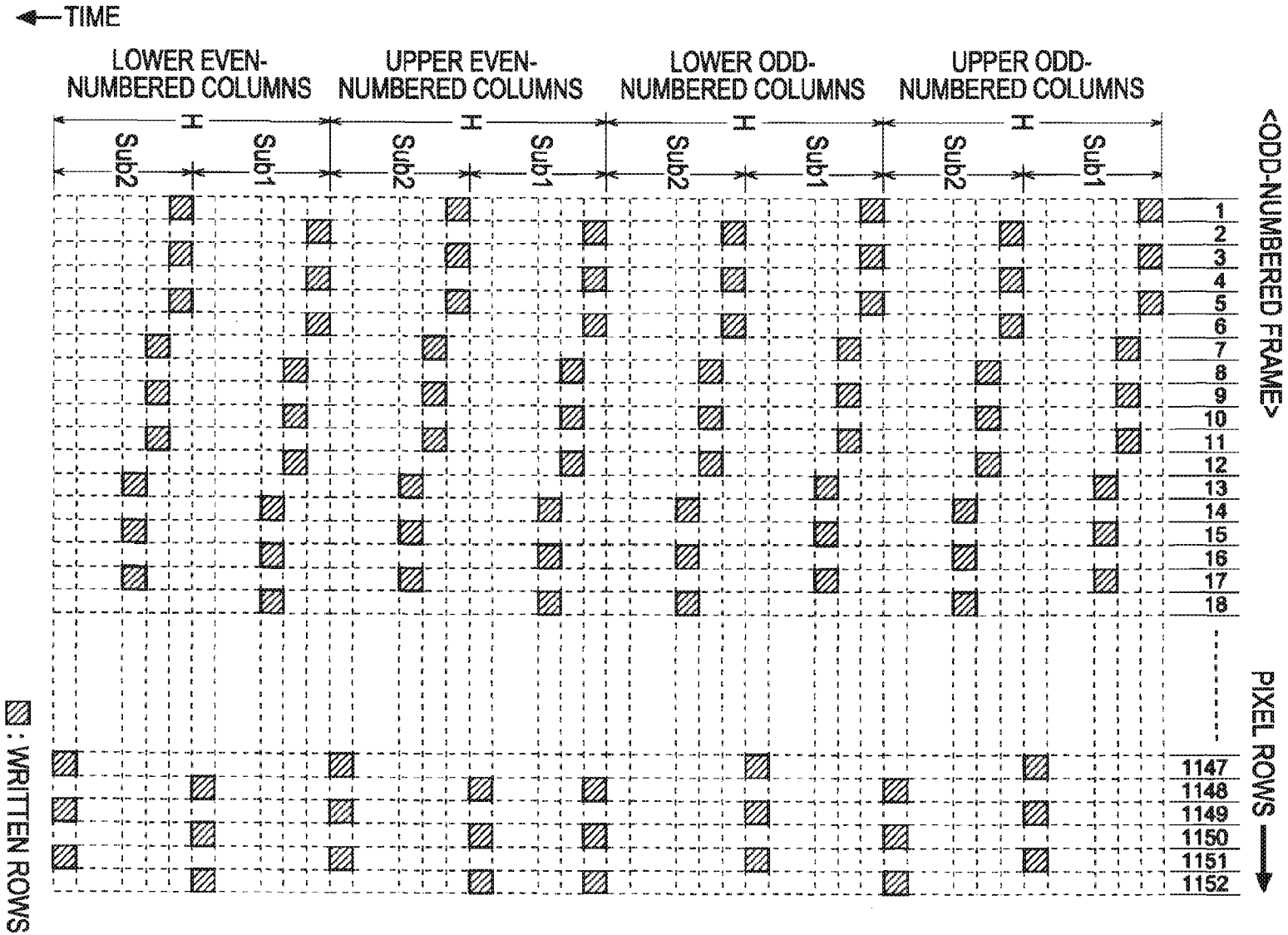
FIG. 21 is a diagram for explaining a writing operation related to the fifth embodiment.

However, in the fifth embodiment, as shown in FIG. 21, in the horizontal scanning period H of the odd-numbered frames where the odd-numbered columns of the scan lines in the upper region are selected, an operation of writing voltage corresponding to the grayscale is performed onto the odd-numbered rows of the sequentially designated blocks in the first period Sub1, and an operation of writing voltage corresponding to the grayscale is performed onto the even-numbered rows of the sequentially designated blocks in the second period Sub2. In this case, the scan lines selected in the next time correspond to the odd-numbered columns of the scan lines in the lower region. As a result, in the horizontal scanning period H of the odd-numbered frames where the odd-numbered columns of the scan lines in the lower region are selected, similarly to the case of the horizontal scanning period where the odd-numbered columns of the scan lines in the upper region are selected, an operation of writing voltage corresponding to the grayscale is performed onto the odd-numbered rows of the sequentially designated blocks in the first period Sub1, and an operation of writing voltage corresponding to the grayscale is performed onto the even-numbered rows of the sequentially designated blocks in the second period Sub2.

The scan lines selected subsequent to the odd-numbered columns of the scan lines in the lower region correspond to the even-numbered columns of the scan lines which are subsequent to the odd-numbered columns of the scan lines in the upper region. As a result, in the horizontal scanning period H of the even-numbered frames where the odd-numbered columns of the scan lines in the upper region are selected, contrary to the case of the horizontal scanning period where the even-numbered columns of the scan lines in the upper region are selected, an operation of writing voltage corresponding to the grayscale is performed onto the even-numbered rows of the sequentially designated blocks in the first period Sub1, and an operation of writing voltage corresponding to the grayscale is performed onto the odd-numbered rows of the sequentially designated blocks in the second period Sub2.

The scan lines selected subsequent to the even-numbered columns of the scan lines in the upper region correspond to the even-numbered columns of the scan lines which are subsequent to the odd-numbered columns of the scan lines in the lower region. As a result, in the horizontal scanning period H of the even-numbered frames where the even-numbered columns of the scan lines in the lower region are selected, contrary to the case of the horizontal scanning period where the odd-numbered columns of the scan lines in the lower region are selected, an operation of writing voltage corresponding to the grayscale is performed onto the even-numbered rows of the sequentially designated blocks in the first period Sub1, and an operation of writing voltage corresponding to the grayscale is performed onto the odd-numbered rows of the sequentially designated blocks in the second period Sub2.

Figure 22:
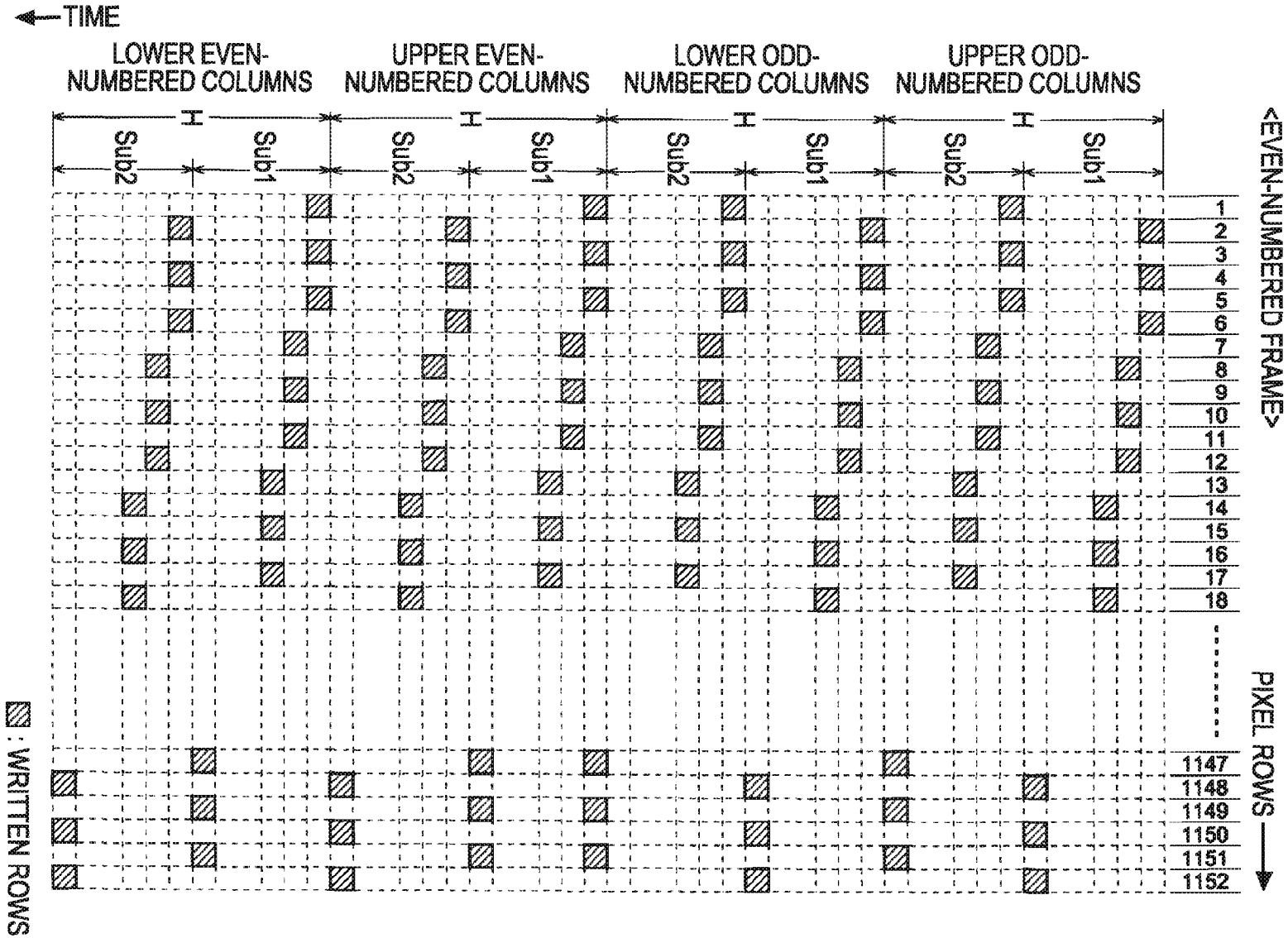
FIG. 22 is a diagram for explaining a writing operation related to the fifth embodiment.

In the subsequent even-numbered frames, as shown in FIG. 22, the relation of the odd-numbered rows and the even-numbered row in the first period Sub1 and the second period Sub2 at each column is changed from the odd-numbered frames.

Figure 23A:
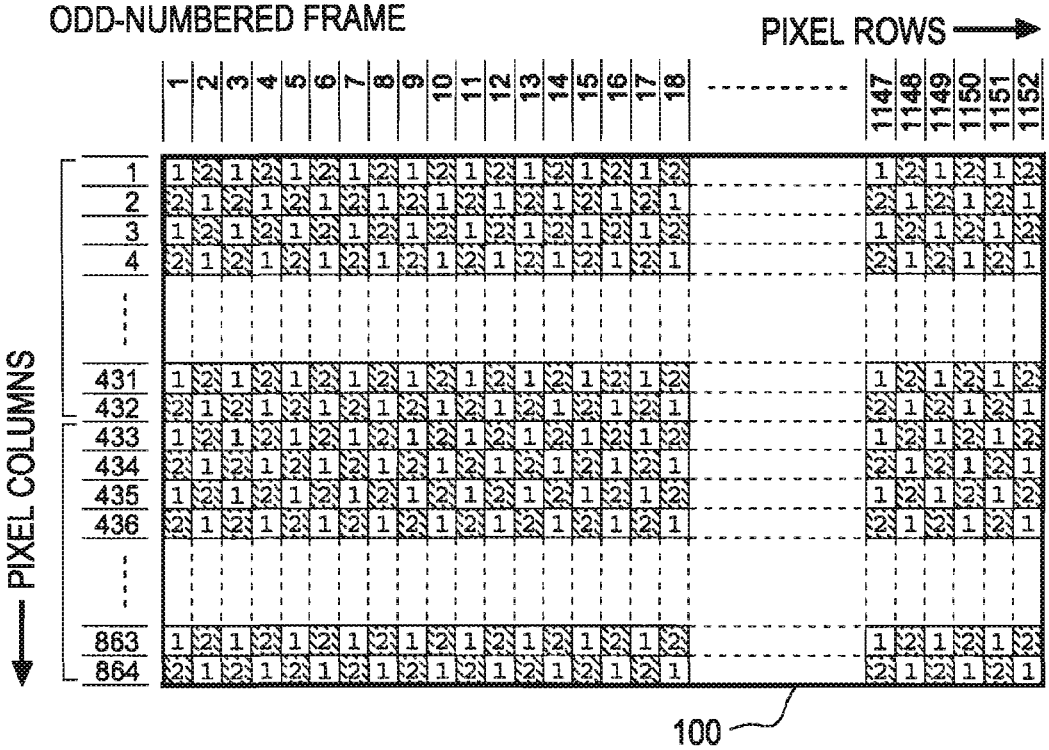
FIGS. 23A and 23B are diagrams showing a written state related to the fifth embodiment.
Figure 23B:
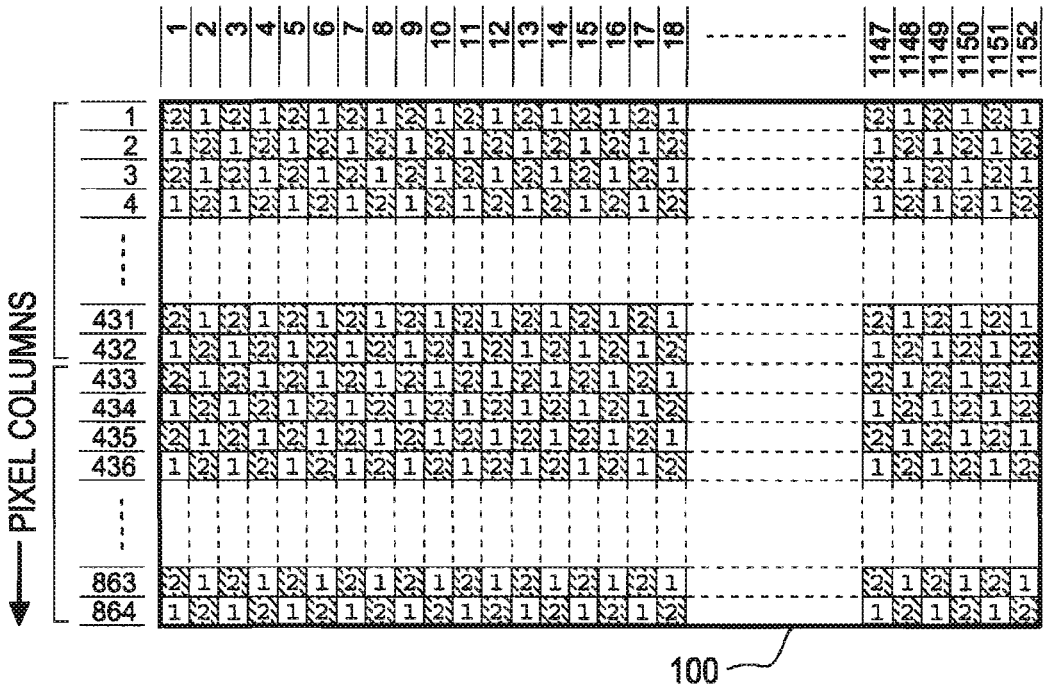

As a result, in the fifth embodiment, considering the entire screen of the display region 100, as shown in FIG. 23A in the case of the odd-numbered frame and in FIG. 23B in the case of the even-numbered frame, pixels (denoted by "1") to which the writing operation is performed and pixels (denoted by "2") to which the writing operation is not performed appear in pixels adjacent to the right and left side of the written rows in such a manner that the two groups of pixels are alternating at every one rows and columns in the same frame and at every temporally adjacent frames. Accordingly, the grayscale difference in the pixels is equalized when the unit period is set to two frames.

According to the fifth embodiment, it is possible to further effectively make the grayscale difference due to the phase-developing method invisible compared with the second and third embodiments by taking advantage of the region scanning method.

Another Example of Shift Register Group

Hereinafter, another example of the shift register group 140 will be described.

In the shift register group 140 shown in FIG. 4, the scan control circuit 52 supplies the transmission start pulse DX1 to the first shift register 142 and the transmission start pulse DX1 to the first shift register 142 in a manner that the supplying method is changed at the beginning of the first period Sub1 or the second period Sub2. More specifically, when the data signals are sampled into the odd-numbered rows of the data lines in the first period Sub1 or the second period Sub2, the scan control circuit 52 supplies the transmission start pulse DX1 at the beginning of the first period Sub1 or the second period Sub2. Moreover, when the data signals are sampled into the even-numbered rows of the data lines in the first period Sub1 or the second period Sub2, the scan control circuit 52 supplies the transmission start pulse DX2 at the beginning of the first period Sub1 or the second period Sub2.

Figure 24:
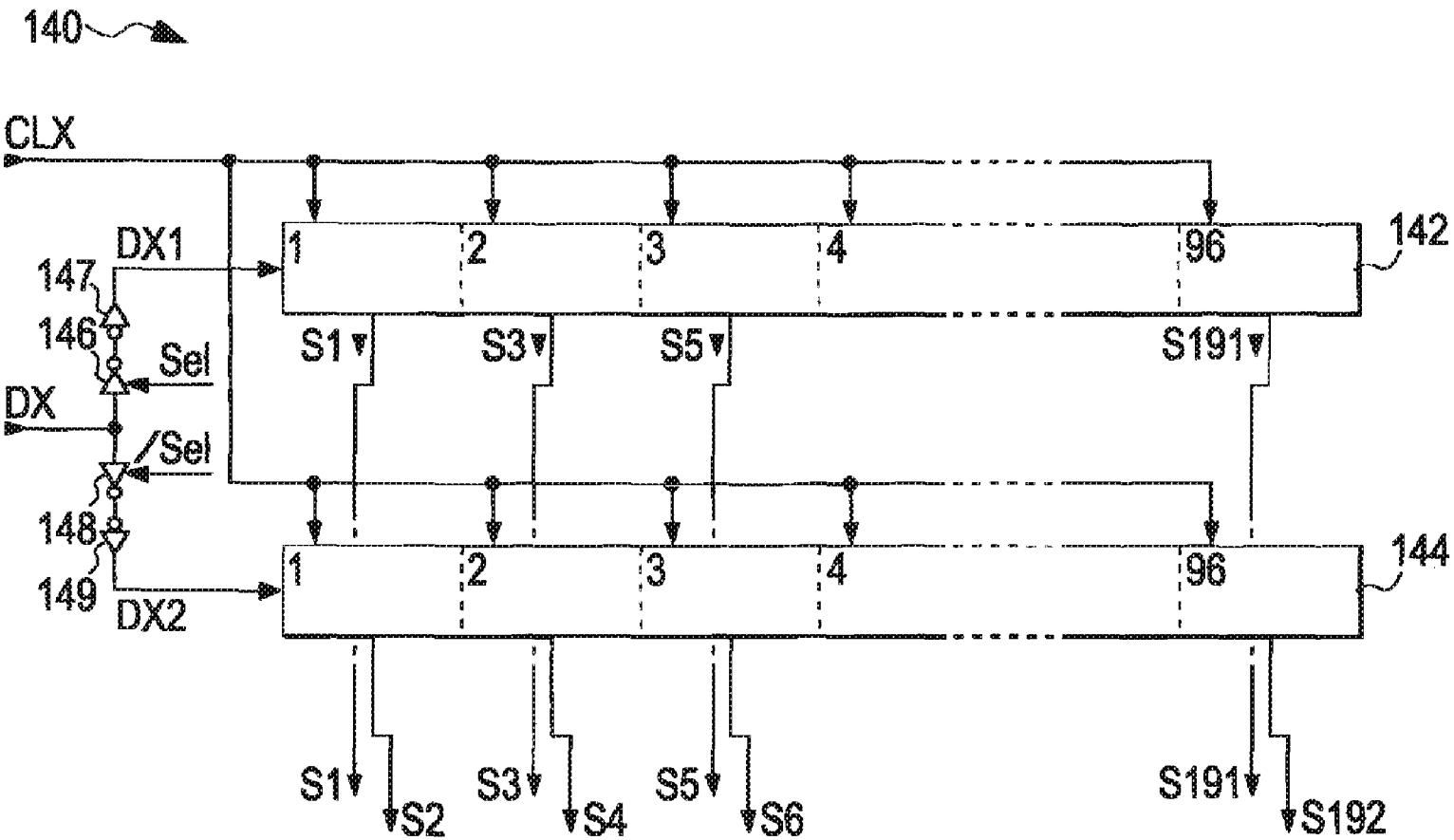
FIG. 24 is a diagram showing a structure of another example of a shift register group.

However, the invention is not limited to this and the shift register group 140 may have the structure as shown in FIG. 24.

In FIG. 24, the shift register group 140 related to another structure exclusively supplies the transmission start pulse DX to the first shift register 142 or the second shift register 144 in response to a signal Sel indicating that the odd-numbered rows should be selected first (a signal /Sel indicates that the even-numbered rows should be selected first).

More specifically, both of clocked inverters 146 and 148 input the transmission start pulse. The clocked inverter 146 performs an inversion operation only when the signal Sel is charged to an H level and outputs a high impedance level when the signal Sel is discharged to an L level. In addition, the clock Inverter 148 performs the inversion operation only when a logically inverted version /Sel of the signal Sel and outputs a high impedance level when the signal /Sel is discharged to an L level.

The inverts 147 and 148 are simple logical inversion circuits.

Figure 25:
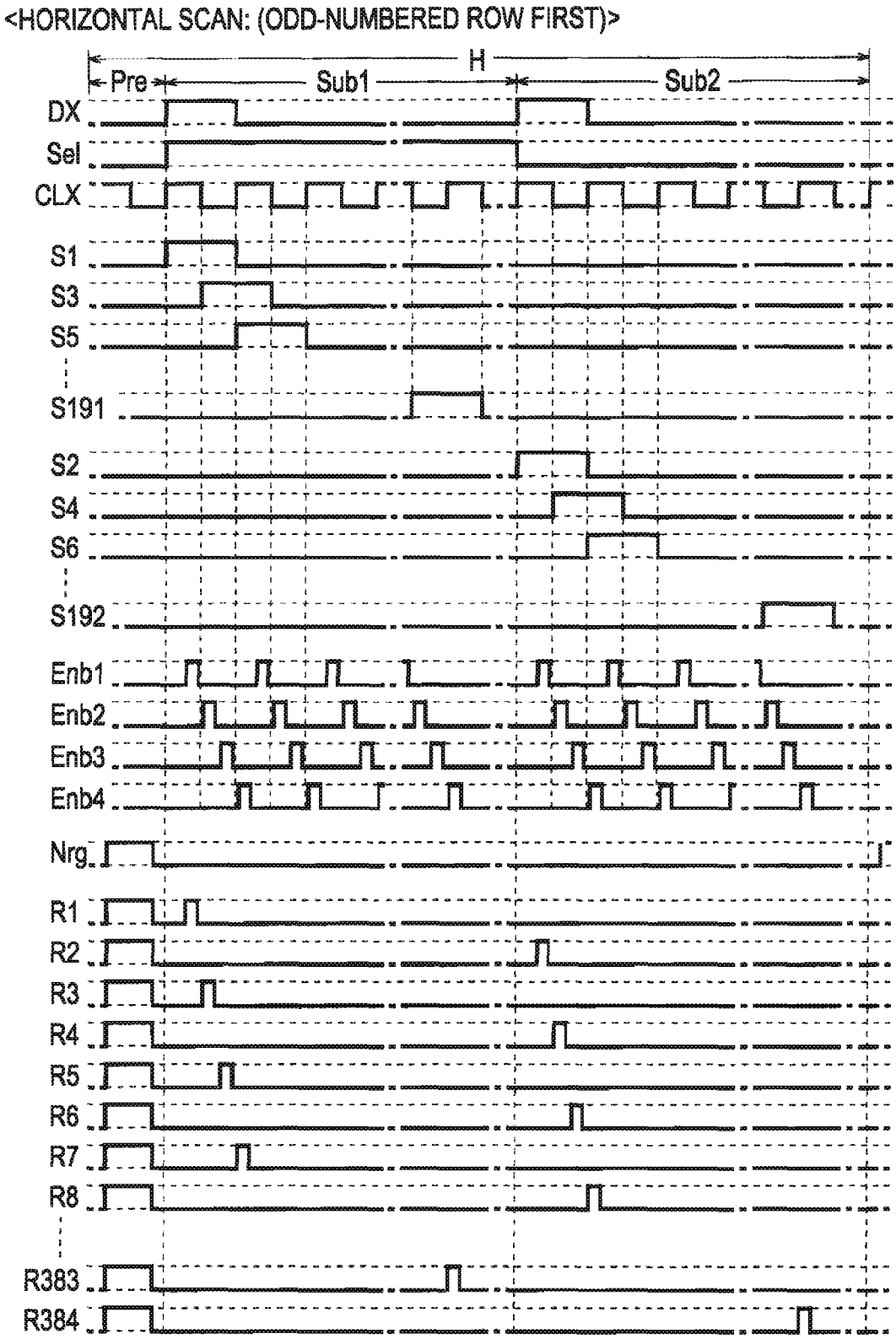
FIG. 25 is a diagram for explaining an operation of a horizontal scanning when the shifter register group is used.
Figure 26:
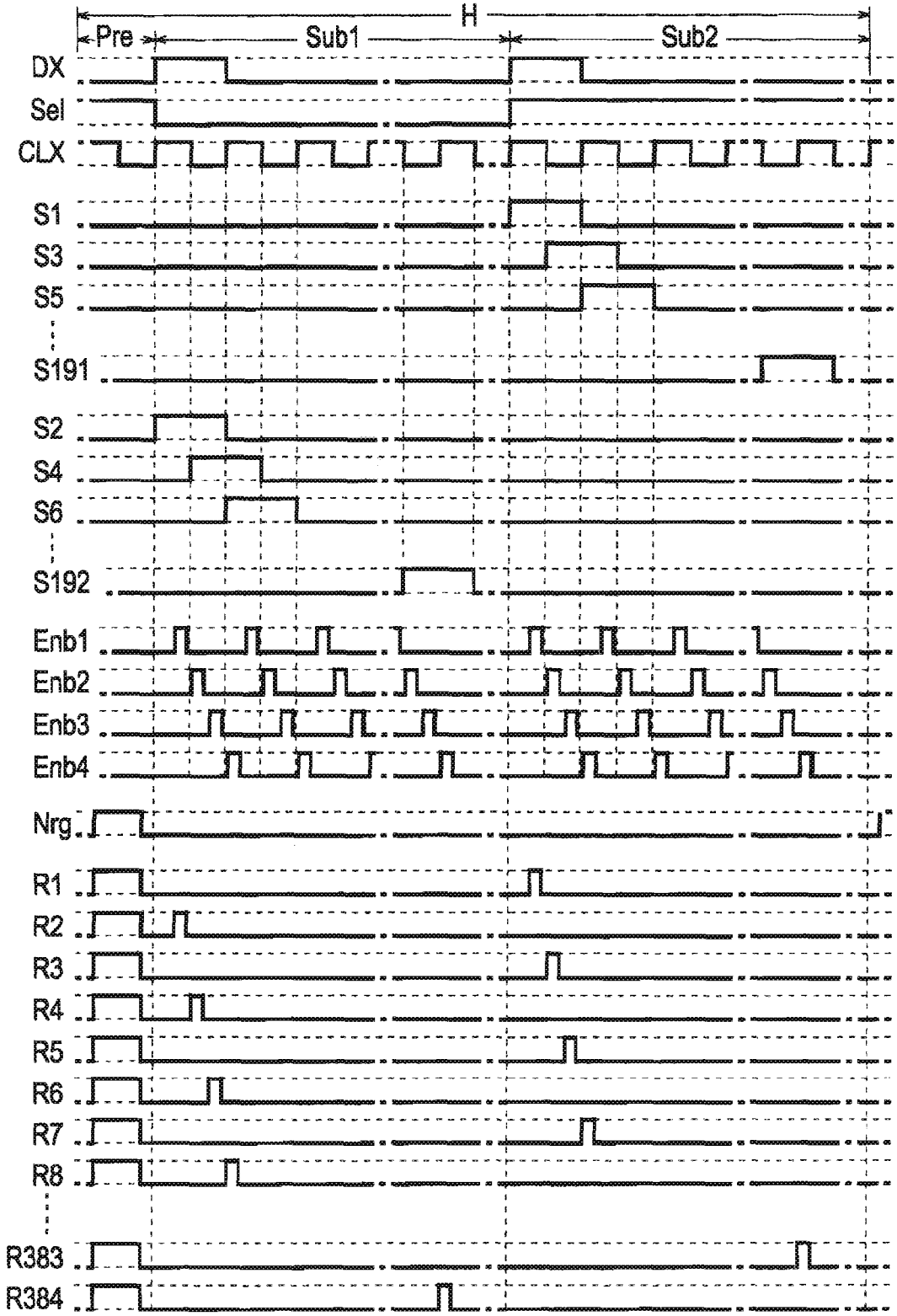
FIG. 26 is a diagram for explaining an operation of a horizontal scanning when the shifter register group is used.

When the shift register group 140 related to another structure is applied to the invention, the scan control circuit 52 outputs the transmission start pulse DX at the beginning of the first period Sub1 and the second period Sub2, as shown in FIGS. 25 and 26.

Moreover, when the scan control circuit 52 samples the data signals into the odd-numbered rows of the data lines in the first period Sub1 and samples the data signals into the even-numbered rows (the front side of the odd-numbered rows) of the data lines in the second period Sub2, the signal Sel is charged to an H level in the first period Sub1 and the signal Sel is discharged to an L level in the second period Sub2, as shown in FIG. 25. In addition, when the data signals are sampled into the even-numbered rows of the data lines in the first period Sub1 and the data signals are sampled into the odd-numbered rows (the front side of the even-numbered rows) of the data lines in the second period Sub2, the signal Sel is discharged to an L level in the first period Sub1 and the signal Sel is charged to an H level in the second period Sub2, as shown in FIG. 26.

Figure 12:
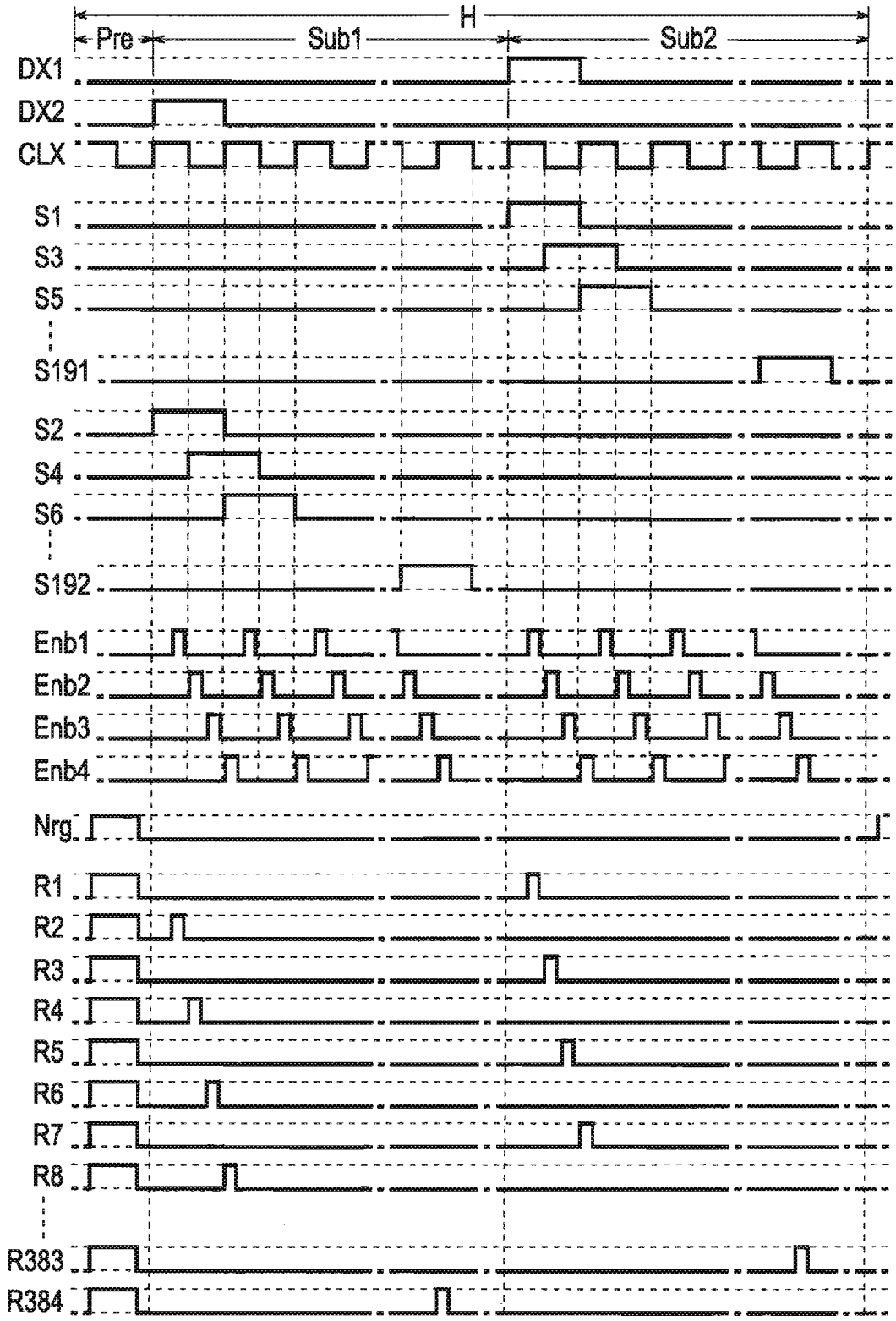
FIG. 12 is a timing diagram for explaining an operation or a horizontal scanning according to a second embodiment of the invention.

As a result, since in the front side of the odd-numbered rows, the transmission start pulse DX is supplied only to the first shift register 142 in the first period Sub1 and the transmission start pulse DX is supplied only to the second shift register 144 in the first period Sub2, the shift signals and the sampling signals have the same waveform as in FIG. 7, as shown in FIG. 25. Meanwhile, since in the front side of the even-numbered rows, the transmission start pulse DX is supplied only to the second shift register 144 in the first period Sub1 and the transmission start pulse DX is supplied only to the first shift register 142 in the first period Sub2, the shift signals and the sampling signals have the same waveform as in FIG. 12, as shown in FIG. 26.

Although, in the first to fifth embodiments, the phase-developed driving number m which is the number of concurrently written data lines was set to 3 and the number of the image lines 162 was set to 3, the m and the number of the image lines 162 may be 2 or more.

Modified Embodiment

Hereinafter, a modified Embodiment of the invention will be described.

In the first to fifth embodiments, an operation of writing voltage is performed onto one of the odd-numbered rows and the even-numbered row in the first period Sub1, and an operation of writing voltage is performed onto the other one of the odd-numbered rows and the even-numbered row in the second period Sub2, so that the written pixels where the writing operation is performed to an adjacent pixel and the written pixels where the writing operation is not performed appear in an alternating manner. The same advantages can be obtained in the modified embodiment shown in FIG. 27.

Figure 27:
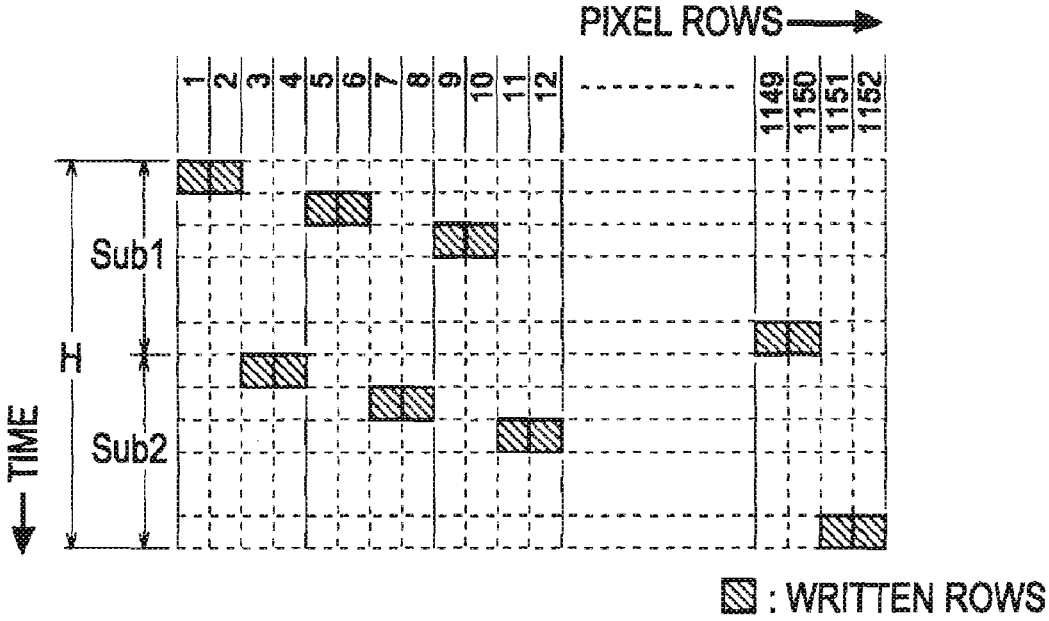
FIG. 27 is a diagram for explaining a writing operation according to a modified embodiment.

More specifically, as shown in FIG. 27, in the modified embodiment, the phase-developed driving number is set to 2, and in the first period Sub1, the data lines are sequentially selected at every two rows so as to sample the data signals, thereby writing voltage of the data signal to the pixels. In the second period Sub2, the data lines which are not selected in the first period Sub1 is selected at every two rows so as to sample the data signals, thereby writing voltage of the data signal to the pixels.

In the modified embodiment, since the phase-developed driving number is set to 2, the number of the data lines belonging to one block is 4.

Figure 28:
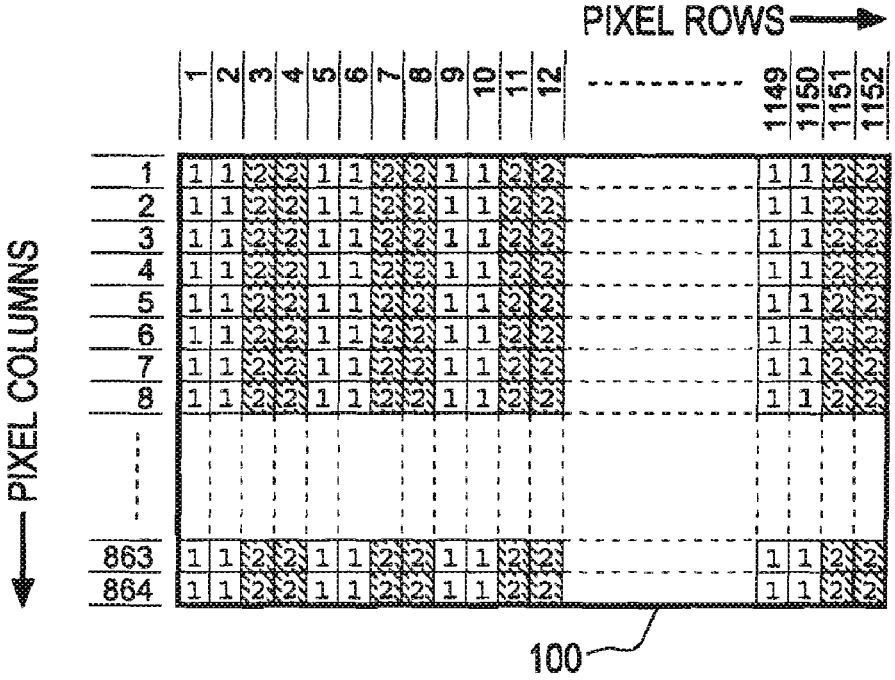
FIG. 28 is a diagram showing a written state related to the modified embodiment.

As a result, in the modified embodiment, considering the entire screen of the display region 100, as shown in FIG. 28, pixels (denoted by "1") to which the writing operation is performed and pixels (denoted by "2") to which the writing operation is not performed are alternatingly appearing at every two rows in pixels adjacent to any one of the right and left side of the written rows. Accordingly, it is possible to make the grayscale difference due to the phase-developing method invisible.

It is needless to say that several aspects of the second to fifth embodiment may be applied to the modified embodiment.

Although, in the above descriptions, the entire data lines 114 were precharged right before the data signals are sampled, the invention is not limited to this.

In addition, although the processing circuit 20 processes the image data Vin of a digital format, the image data of an analog format may be input and phase-developed.

In the above-mentioned embodiments, the voltage LCcom applied to the common electrode 108 corresponds to the voltage Vc which is a reference for the polarity inversion.

However, when the TFT is an N-channel type, a phenomenon (also referred to as push-down, penetration and field-through) in which the potential of the drain (the pixel electrode 118) decreases at the time of on-off switching due to a parasitic capacitance between the gate and the drain of the TFT is occurred. Since the pixel capacitor is basically AC-driven in order to prevent deterioration in the liquid crystal, a high-potential side voltage (positive polarity) and a low-potential side voltage (negative polarity) are alternatingly written onto the common electrode 108. When the writing operation is performed in a state that the voltage LCcom corresponds to the voltage Vc, the effective voltage value of the pixel capacitor for the negative writing operation may become greater than those for the positive writing operation due to the push-down For this reason, there are cases where the voltage LCcom of the common electrode 108 is set to a value slightly lower than the voltage Vc which is a reference amplitude of the data signals, so that the effective voltage values of the pixel capacitor become equal when the positive and negative writing operations are performed with the same grayscale.

In the above-mentioned embodiments, when viewed from FIG. 2, the vertical scanning direction is directed toward a lower side and the horizontal scanning direction is directed toward a rightmost side. However, the scanning direction may be changed in order to cope with a projector described later or a rotatable display apparatus.

Although the normally-white mode of performing the white display when the effective voltage value of the pixel capacitor is small has been described in the above-mentioned embodiments, a normally-black mode of performing the black display may be employed, In addition, the liquid crystal devices has been described in the above-mentioned embodiments, the invention may be applied to EL (electronic luminescence) devices, electron emitters, electrophoresis devices, digital mirrors, as far as they are capable of phase-develop image data (picture signal) and currently sampling a plurality of data lines Electronic Apparatus Next, a projector having the above-mentioned liquid crystal panel 100 as light valves will be described as an example of the electronic apparatus using the electro-optical device according to the above-mentioned embodiments.

Figure 29:
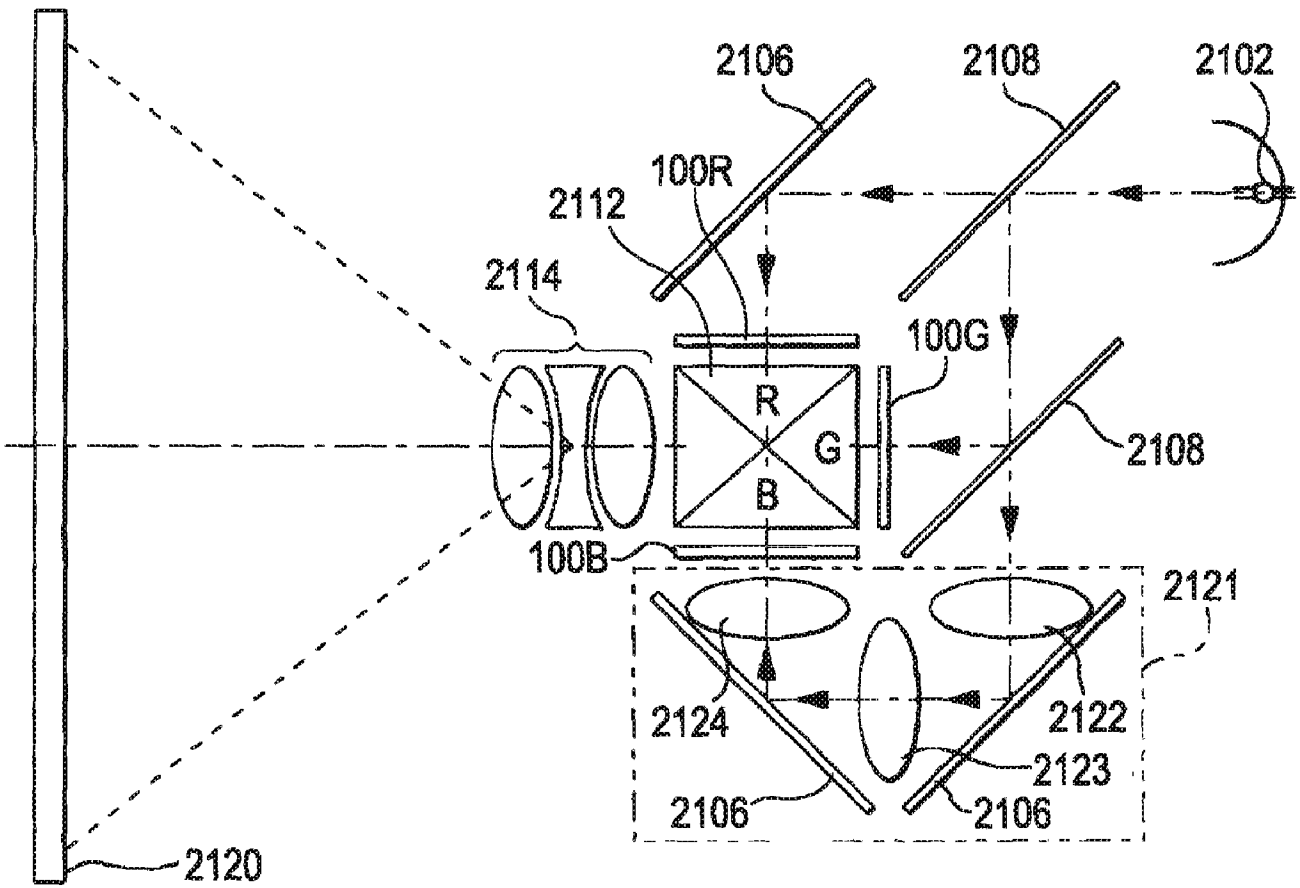
FIG. 29 is a diagram showing a structure of a projector to which the elector-optical device is applied.

FIG. 29 is a plan view showing a structure of the projector. As shown in FIG. 29, a lamp unit 2102 having a white light source such as a halogen lamp, etc. is provided inside the projector 2100. The projection light emitted from the lamp unit 2102 is separated into three primary colors of R (red color), G (green color), and B (blue color) by three mirrors 2106 and two dichroic mirrors 2108 disposed therein, and is then guided to light valves 100R, 100G, and 100B corresponding to the respective primary colors. Since the light component of B color has an optical path longer than those of R color or G color, the light component of B color is guided through a relay lens system 2121 including an incident lens 2122, a relay lens 2123, and an emission lens 2124 so as to prevent loss thereof.

Here, the light valves 100R, 100G, and 100B have the same structure as that of the liquid crystal panel 10 according to the above-mentioned embodiment, and are driven with the image signals corresponding to the respective colors R, G, and B supplied from a processing circuit (not shown in FIG. 29). In other words, in the projector 2100, three electro-optical devices including the liquid crystal panel 10 are provided correspondingly to the respective colors R, G, and B.

The light components modulated by the light valves 100R, 100G, and 100B, respectively, are incident on the dichroic prism 2112 from three directions. In the dichroic prism 2112, the light components of R color and B color are refracted by 90 degrees, while the light component of G color passes therethrough. Therefore, after the images of the respective colors are synthesized, a color image is projected onto a screen 2120 through a projection lens 2114.

Since the light components corresponding to the respective primary colors R, G, and B are applied to the light valves 100R, 100G, and 100B through the dichroic mirror 2108, it is not necessary to provide a color filter. The images passing through the light valves 100R and 100B are reflected from the dichroic mirror 2112 and then projected, while the image passing through the light valve 100G is projected as it is. As a result, the horizontal scan direction by the light valves 100R and 100B is opposite to the horizontal scan direction by the light valve 100G, so that the images of which the right and left sides are reversed are displayed.

In addition to those described with reference to FIG. 29, examples of the electronic apparatus may include a television, a view finder type or monitor direct vision-type video tape recorder, a car navigation apparatus, a pager, an electronic pocket book, a calculator, a word processor, a work station, a television phone, a POS terminal, a digital still camera, an apparatus having a touch panel, and the like. It is needless to say that the electro-optical device according to the invention can be applied to various electronic apparatuses.

The entire disclosure of Japanese Patent Application No. 2006-052202, filed Feb. 28, 2006 is expressly incorporated by reference herein.

What is claimed is:

1. An electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, comprising:

a scan line driving circuit that selects the plurality of scan lines in a predetermined order; and a data line driving circuit that:

divides the plurality of data lines into blocks to form blocks each consisting of 2m data lines where m is an integer greater than or equal to 2 and less than a total number of odd-numbered data lines or even-numbered data lines, divides a period of time, when a first scan line is selected, into a first period and a second period;

sequentially specifies at least two blocks in each of the first and second periods when the first scan line is selected, in the first period when the first scan line is selected, simultaneously selects m data lines from an odd group consisting of odd-numbered data lines belonging to the specified block;

in the second period when the first scan line is selected, simultaneously selects m data lines from an even group consisting of even-numbered data lines belonging to the specified block;

divides a period of time, when a second scan line next to the first scan line is selected, into a first period and a second period;

sequentially specifies at least two blocks in each of the first and second periods when the second scan line is selected, in the first period when the second scan line is selected, simultaneously selects m data lines from the even group consisting of even-numbered data lines belonging to the specified block;

in the second period when the second scan line is selected, simultaneously selects m data lines from the odd group consisting of odd-numbered data lines belonging to the specified block; and samples data signals supplied to m image signal lines and supplies the sampled data signals to the selected m data lines.

2. An electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, comprising:

a scan line driving circuit that selects the plurality of scan lines in a predetermined order; and a data line driving circuit that:

divides the plurality of data lines into blocks to form blocks each consisting of 2m data lines where m is an integer greater than or equal to 2 and less than a total number of odd-numbered data lines or even-numbered data lines, divides a period of time, when one of the scan lines is selected, into a first period and a second period;

sequentially specifies at least two blocks in each of the first and second periods, in a first period of a first vertical scanning period, simultaneously selects m data lines from an odd group consisting of odd-numbered data lines belonging to the specified block;

in a second period of the first vertical scanning period, simultaneously selects m data lines from an even group consisting of even-numbered data lines belonging to the specified block;

in a first period of a second vertical scanning period, simultaneously selects m data lines from the even group consisting of even-numbered data lines belonging to the specified block;

in a second period of the second vertical scanning period, simultaneously selects m data lines from the odd group consisting of odd-numbered data lines belonging to the specified block; and samples data signals supplied to m image signal lines and supplies the sampled data signals to the selected m data lines.

3. An electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, comprising:

a scan line driving circuit that selects the plurality of scan lines in a predetermined order; and a data line driving circuit that:

divides the plurality of data lines into blocks to form blocks each consisting of 2m data lines where m is an integer greater than or equal to 2 and less than a total number of odd-numbered data lines or even-numbered data lines, divides a period of time, when one of the scan lines is selected, into a first period and a second period;

sequentially specifies at least two blocks in each of the first and second periods, in a first period of a first vertical scanning period when an odd-numbered scan line is selected, simultaneously selects m data lines from an odd group consisting of odd-numbered data lines belonging to the specified block;

in a second period of the first vertical scanning period when an odd-numbered scan line is selected, simultaneously selects m data lines from an even group consisting of even-numbered data lines belonging to the specified block;

in a first period of the first vertical scanning period when an even-numbered scan line is selected, simultaneously selects m data lines from an even group consisting of even-numbered data lines belonging to the specified block;

in a second period of the first vertical scanning period when an even-numbered scan line is selected, simultaneously selects m data lines from an odd group consisting of odd-numbered data lines belonging to the specified block;

in a first period of a second vertical scanning period next to the first vertical scanning period when an odd-numbered scan line is selected, simultaneously selects m data lines from an even group consisting of even-numbered data lines belonging to the specified block;

in a second period of the second vertical scanning period when an odd-numbered scan line is selected, simultaneously selects m data lines from an odd group consisting of odd-numbered data lines belonging to the specified block;

in a first period of the second vertical scanning period when an even-numbered scan line is selected, simultaneously selects m data lines from an odd group consisting of odd-numbered data lines belonging to the specified block;

in a second period of the second vertical scanning period when an even-numbered scan line is selected, simultaneously selects m data lines from an even group consisting of even-numbered data lines belonging to the specified block; and samples data signals supplied to m image signal lines and supplies the sampled data signals to the selected m data lines.

4. An electro-optical device having a plurality of pixels which are formed to correspond to intersections between a plurality of scan lines and a plurality of data lines and each of which exhibits a grayscale of output light corresponding to a data signal sampled and supplied to the corresponding data line when the corresponding scan line is selected, comprising:

a scan line driving circuit that selects the plurality of scan lines in a predetermined order; and a data line driving circuit that:

divides the plurality of data lines into blocks so as to form blocks each consisting of two data lines, each block consisting of an odd-numbered data line and an even-numbered data line, and divides a period of time, when one of the scan lines is selected, into a first period and a second period;

sequentially selects one of odd blocks and even blocks and selects two data lines belonging to the selected block in the first period;

sequentially selects an other of the odd blocks and the even blocks and selects two data lines belonging to the selected block in the second period; and samples data signals supplied to two image signal lines and supplies the sampled data signals to the selected two data lines, wherein each of the odd blocks consists of two sequential data lines, the sequential data lines being one odd-numbered data line and one even-numbered data line, and each of the even blocks consists of two sequential data lines, the sequential data lines being one odd-numbered data line and one even-numbered data line.

5. An electronic apparatus comprising the electro-optical device according to claim 1.

6. An electronic apparatus comprising the electro-optical device according to claim 2.

7. An electronic apparatus comprising the electro-optical device according to claim 3.

8. An electronic apparatus comprising the electro-optical device according to claim 4.

* * * * *